US007154459B2

(12) United States Patent
Lee

(10) Patent No.: US 7,154,459 B2
(45) Date of Patent: Dec. 26, 2006

(54) LIQUID CRYSTAL DISPLAY AND A DRIVING METHOD THEREOF

(75) Inventor: Baek-woon Lee, Yongin (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 10/992,220

(22) Filed: Nov. 19, 2004

(65) Prior Publication Data

US 2005/0088398 A1 Apr. 28, 2005

Related U.S. Application Data

(62) Division of application No. 09/773,603, filed on Feb. 2, 2001, now Pat. No. 6,825,824.

(30) Foreign Application Priority Data

Feb. 3, 2000 (KR) ..... 2000-5442
Jul. 27, 2000 (KR) ..... 2000-43509
Dec. 6, 2000 (KR) ..... 2000-73672

(51) Int. Cl.
*G09G 3/36* (2006.01)

(52) U.S. Cl. ..... 345/89; 345/690

(58) Field of Classification Search ..... 345/89, 345/94, 99, 690
See application file for complete search history.

(56) References Cited

U.S. PATENT DOCUMENTS 5,111,195 A * 5/1992 Fukuoka et al. ..... 345/204
5,465,102 A 11/1995 Usui et al. ..... 345/89
5,844,533 A 12/1998 Usui et al. ..... 345/89
5,905,484 A 5/1999 Verhuist ..... 345/98
6,825,824 B1 * 11/2004 Lee ..... 345/89

FOREIGN PATENT DOCUMENTS

JP 4-268599 9/1992
JP 10-39837 2/1998
TW 85113451 10/2000

* cited by examiner

*Primary Examiner*—Ricardo Osorio
(74) *Attorney, Agent, or Firm*—Cantor Colburn LLP

(57) ABSTRACT

Disclosed is an LCD and driving method thereof. The present invention comprises a data gray signal modifier for receiving gray signals from a data gray signal source, and outputting modification gray signals by consideration of gray signals of present and previous frames; a data driver for changing the modification gray signals into corresponding data voltages and outputting image signals; a gate driver for sequentially supplying scanning signals; and an LCD panel comprising a plurality of gate lines for transmitting the scanning signals; a plurality of data lines, being insulated from the gate lines and crossing them, for transmitting the image signals; and a plurality of pixels, formed by an area surrounded by the gate lines and data lines and arranged as a matrix pattern, having switching elements connected to the gate lines and data lines.

40 Claims, 16 Drawing Sheets

Fig.10

| Gn' | | Gn | | | | | | | |
|---|---|---|---|---|---|---|---|---|---|
| | | 0 | 1 | 2 | 2 | ... | 253 | 254 | 255 |
| Gn-1 | 0 | 0 | 1 | 3 | 5 | ... | 255 | 255 | 255 |
| | 1 | 0 | 1 | 3 | 4 | ... | 255 | 255 | 255 |
| | 2 | 0 | 1 | 2 | 3 | ... | 255 | 255 | 255 |
| | 3 | 0 | 0 | 2 | 3 | ... | 255 | 255 | 255 |
| | ⋮ | ⋮ | ⋮ | ⋮ | ⋮ | ⋮ | ⋮ | ⋮ | ⋮ |
| | 253 | 0 | 0 | 0 | 0 | ... | 253 | 254 | 255 |
| | 254 | 0 | 0 | 0 | 0 | ... | 253 | 254 | 255 |
| | 255 | 0 | 0 | 0 | 0 | ... | 252 | 253 | 255 |

LIQUID CRYSTAL DISPLAY AND A DRIVING METHOD THEREOF

CROSS REFERENCE TO PRIOR APPLICATIONS

This application is a Divisional Application from U.S. patent application Ser. No. 09/773,603, filed Feb. 2, 2001 now U.S. Pat. No. 6,825,824, which claims priority to and the benefit of Korean Patent Application Nos. 2000-5442, filed on Feb. 3, 2000; 2000-43509, filed on Jul. 27, 2000; and 2000-73672, filed on Dec. 6, 2000, which are all hereby incorporated by reference for all purposes as if fully set forth herein.

BACKGROUND OF THE INVENTION (a) Field of the Invention

The present invention relates to a Liquid Crystal Display (LCD) and a driving method thereof. More specifically, the present invention relates to an LCD and a driving method for providing compensated data voltage in order to improve a response time of the liquid crystal.

(b) Description of the Related Art

As personal computers (PC) and televisions have recently become lighter in weight and slimmer in thickness, lighter and slimmer display devices have also been in great demands. Accordingly, flat panel type displays such as an LCD instead of a cathode ray tube (CRT) have been developed.

In the LCD, a liquid crystal layer having anisotropic permittivity is injected between two substrates of a panel, and the light transmittivity of the panel is controlled by applying and controlling the electric field. Desired images are obtained in such a manner. An LCD is one of the most commonly used portable flat panel display devices. In particular, the thin film transistor liquid crystal display (TFT-LCD) employing the TFT as a switching element is most widely used.

As more TFT-LCDs have been used as display devices of computers and televisions, it becomes increasingly important to implement moving pictures on the TFT-LCD. However, conventional TFT-LCDs have a relatively slow response speed. So it is difficult to implement moving pictures on the conventional TFT-LCD. To solve the problem of the slow response speed, different type of TFT-LCD that uses the optically compensated band (OCB) mode or ferro-electric liquid crystal (FLC) has been developed.

However, the structure of the conventional TFT-LCD panel must be modified to use the OCB mode or the FLC.

SUMMARY OF THE INVENTION

It is an object of the present invention to enhance the response speed of the liquid crystal by modifying the liquid crystal driving method without modifying the structure of the TFT-LCD.

In one aspect of the present invention, an LCD comprises: a data gray signal modifier for receiving gray signals from a data gray signal source, and outputting modification gray signals by considering gray signals of present and previous frames; a data driver for changing the modification gray signals into corresponding data voltages and outputting image signals; a gate driver for sequentially supplying scanning signals; and an LCD panel comprising a plurality of gate lines for transmitting the scanning signals; a plurality of data lines, being insulated from the gate lines and crossing them, for transmitting the image signals; and a plurality of pixels, formed by an area surrounded by the gate lines and data lines and arranged as a matrix pattern, having switching elements connected to the gate lines and data lines.

The data gray signal modifier comprises: a frame storage device for receiving the gray signals from the data gray signal source, storing the gray signals during a single frame, and outputting the same; a controller for controlling writing and reading the gray signals of the frame storage device; and a data gray signal converter for considering the gray signals of a present frame transmitted by the data gray signal source and the gray signals of a previous frame transmitted by the frame storage device, and outputting the modification gray signals.

The LCD further comprises: a combiner for receiving the gray signals from the data gray signal source, combining the gray signals to be synchronized with the clock signal frequency with which the controller is synchronized, and outputting the combined gray signals to the frame storage device and the data gray signal converter; and a divider for dividing the gray signals output by the data gray signal converter so as to be synchronized with the frequency with which the gray signals transmitted by the data gray signal source are synchronized.

In another aspect of the present invention, in an LCD driving method comprising a plurality of gate lines; a plurality of data lines being insulated from the gate lines and crossing them; and a plurality of pixels, formed by an area surrounded by the gate lines and data lines and arranged as a matrix pattern, having switching elements connected to the gate lines and data lines, an LCD driving method comprises: (a) sequentially supplying scanning signals to the gate lines; (b) receiving image signals from an image signal source, and generating modification image signals by considering image signals of present and previous frames; and (c) supplying data voltages corresponding to the generated modification image signals to the data lines.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIG. 10 shows a conversion table according to the first preferred embodiment of the present invention;

DETAILED DESCRIPTION OF THE PREFERRED EMBODIMENTS

In the following detailed description, only the preferred embodiment of the invention has been shown and described, simply by way of illustrating of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

The LCD comprises a plurality of gate lines which transmit scanning signals, a plurality of data lines which cross the gate lines and transmit image data, and a plurality of pixels which are formed by regions defined by the gate lines and data lines, and are interconnected through the gate lines, data lines, and switching elements.

Figure 1:
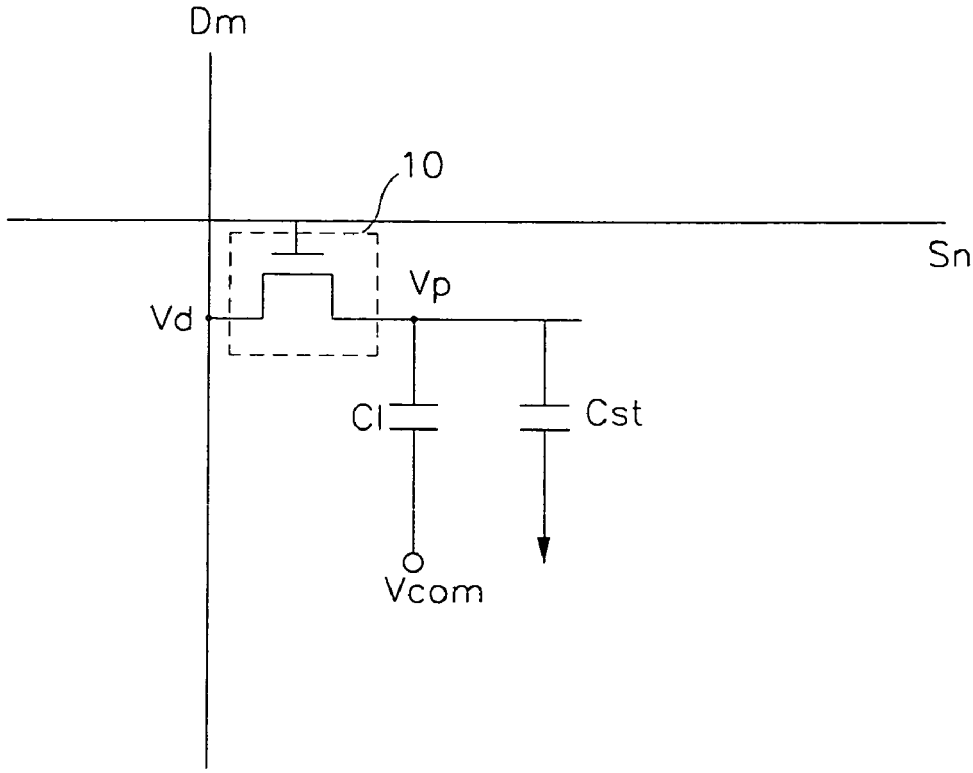
FIG. 1 shows an equivalence circuit of an LCD pixel.

Each pixel of the LCD can be modeled as a capacitor having the liquid crystal as dielectric material, that is, a liquid crystal capacitor. FIG. 1 shows an equivalence circuit of the pixel of the LCD.

As shown, the LCD pixel comprises a TFT 10 having a source electrode connected to a data line $D_m$ and a gate electrode connected to a gate line $S_n$, a liquid crystal capacitor $C_1$ connected between a drain electrode of the TFT 10 and a common voltage $V_{com}$, and a storage capacitor $C_{st}$ connected to the drain electrode of the TFT 10.

When a gate ON signal is supplied to the gate line Sn to turn on the TFT 10, the data voltage $V_d$ supplied to the data line is supplied to each pixel electrode (not illustrated) via the TFT 10. Then, an electric field corresponding to a difference between the pixel voltage Vp supplied to the pixel electrode and the common voltage $V_{com}$ is supplied to the liquid crystal (shown as the liquid crystal capacitor in FIG. 1) so that the light permeates the TFT with a transmission corresponding to a strength of the electric field. At this time, the pixel voltage $V_p$ is maintained during one frame period. The storage capacitor $C_{st}$ is used in an auxiliary manner so as to maintain the pixel voltage $V_p$ supplied to the pixel electrode.

Since the liquid crystal has anisotropic permittivity, the permittivity depends on the directions of the liquid crystal. That is, when a direction of the liquid crystal changes as the voltage is supplied to the liquid crystal, the permittivity also changes, Accordingly, the capacitance of the liquid crystal capacitor (which will be referred to as the liquid crystal capacitance) also changes. After the liquid crystal capacitor is charged while the TFT is turned ON, the TFT is then turned OFF. If the liquid crystal capacitance changes, the pixel voltage $V_p$ at the liquid crystal also changes, since Q=CV.

For example, in a normally white mode twisted nematics (TN) LCD, when zero voltage is supplied to the pixel, the liquid crystal capacitance C(0V) becomes $\epsilon_{\perp}A/d$, where $\epsilon_{\perp}$ represents the permittivity when the liquid crystal molecules are arranged in parallel the LCD substrate, that is, when the liquid crystal molecules are arranged in the direction perpendicular to the direction of the light. 'A' represents the area of the LCD substrate, and 'd' represents the distance between the substrates. If the voltage for implementing a full black is set to be 5V, when the 5V voltage is supplied to the liquid crystal, the liquid crystal is arranged in the direction perpendicular to the substrate, and therefore, the liquid crystal capacitance C(5V) becomes $\epsilon_{//}A/d$. Since $\epsilon_{//}-\epsilon_{\perp}>0$ in the case of the liquid crystal used in the TN mode, the more the pixel voltage sis upplied to the liquid crystal, the greater becomes the liquid crystal capacitance.

The amount of charge necessary for making the n-th frame full black is C(5V)×5V. However, let's assume that the (n−1)th frame is full white ($V_{n-1}$=0V). Then, the liquid crystal capacitance becomes C(0V) since the liquid crystal has not yet responded during the TFT's turn ON period. Hence, even when the n-th frame supplies 5V data voltage Vd to the pixel, the actual amount of the charge provided to the pixel becomes C(0V)×5V, and since C(0V)<C(5V), the pixel voltage below 5V (e.g., 3.5V) is actually supplied to the liquid crystal, and the full black is not implemented. Further, when the (n+1)th frame supplies 5V data voltage $V_d$ so as to implement the full black, the amount of the charge actually provided to the liquid crystal becomes C(3.5V)×5V. Accordingly, the voltage $V_p$ actually supplied to the liquid crystal ranges between 3.5V and 5V. After repeating the above-noted process, the pixel voltage $V_p$ reaches a desired voltage after a few frames.

The above-noted description will now be described with respect to gray levels. When a signal (a pixel voltage) supplied to a pixel changes from a lower gray to a higher gray (or from a higher gray to a lower gray), the gray level of the present frame reaches the desired gray level after a few frames. It is because the gray level of the present frame is affected by the gray level of the previous frame. In a similar manner, the permittivity of the pixel of the present frame reaches a desired value after a few frames since the permittivity of the pixel of the present frame is affected by that of the pixels of the previous frame.

If the (n−1)th frame is full black, that is, the pixel voltage $V_p$ is 5V, and the n-th frame supplies 5V data voltage so as to implement the full black, the amount of the charge corresponding to C(5V)×5V is charged to the pixel since the liquid crystal capacitance is C(5V), and accordingly, the pixel voltage $V_p$ of the liquid crystal becomes 5V.

Therefore, the pixel voltage $V_p$ actually supplied to the liquid crystal is determined by the data voltage supplied to the present frame as well as the pixel voltage $V_p$ of the previous frame.

Figure 2:
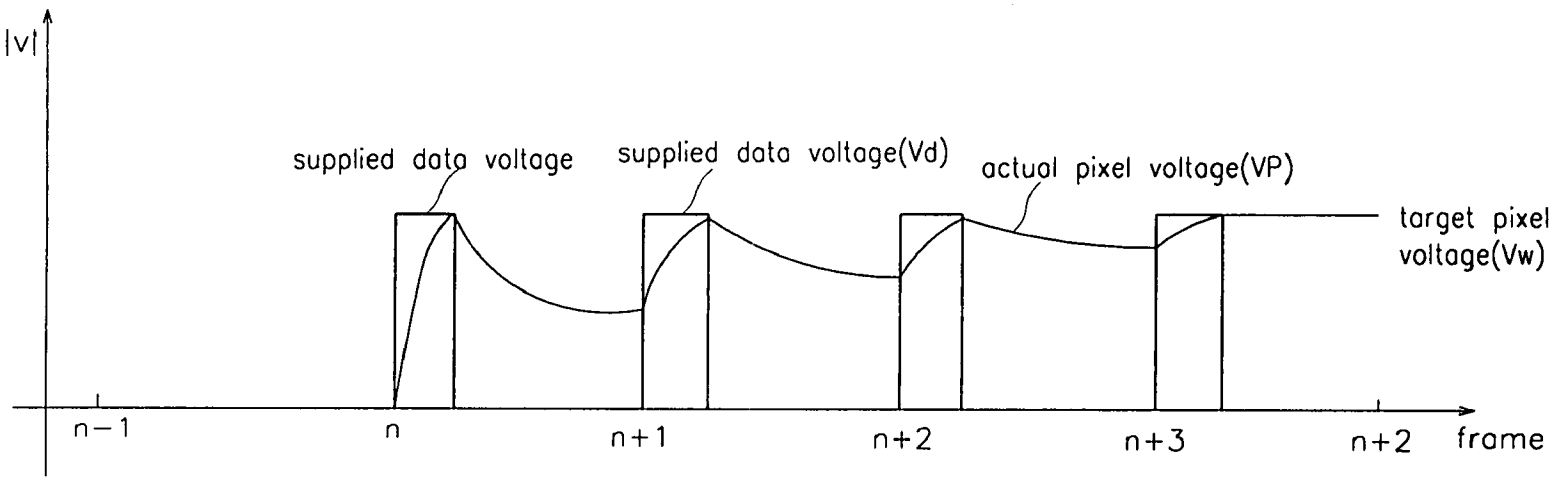
FIG. 2 shows data voltages and pixel voltages supplied by a prior driving method.

FIG. 2 shows the data voltages and pixel voltages supplied by a conventional driving method.

As shown, the data voltage $V_d$ corresponding to a target pixel voltage $V_w$ is conventionally supplied for each frame without regarding the pixel voltage $V_p$ of the previous frame. Hence, the actual pixel voltage $V_p$ supplied to the liquid crystal becomes lower or higher than the target pixel voltage by the liquid crystal capacitance corresponding to the pixel voltage of the previous frame, as described above. Hence, the pixel voltage $V_p$ reaches the target pixel voltage after a few frames.

Figure 3:
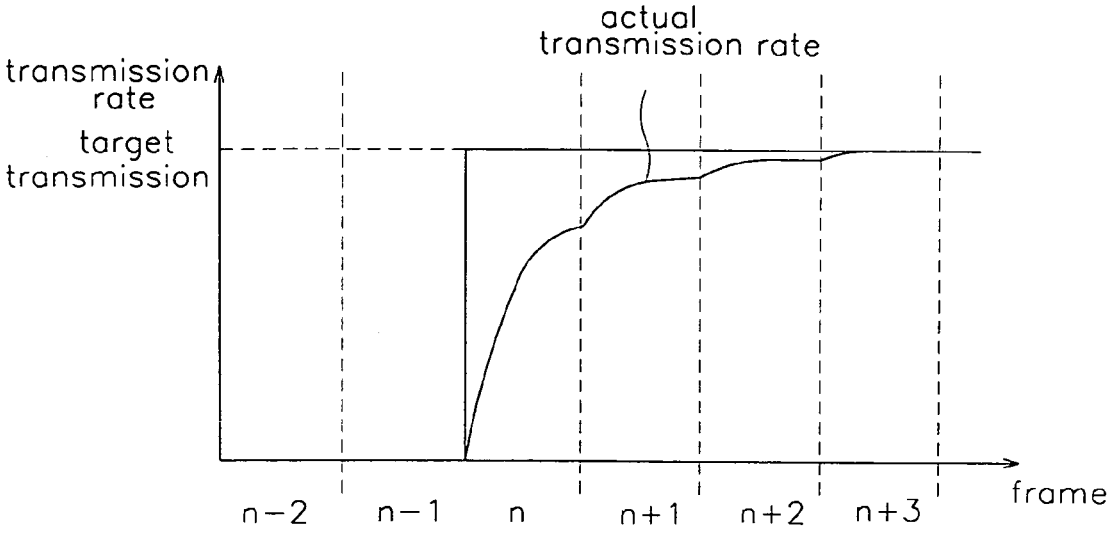
FIG. 3 shows a light transmission rate of the LCD according to a conventional driving method.

FIG. 3 shows a transmission rate of the LCD according to the conventional driving method.

As shown, since the actual pixel voltage becomes lower than the target pixel voltage, the transmission rate reaches the target transmission rate after a few frames even when the response time of the liquid crystal is within one frame.

In the preferred embodiment of the present invention, a picture signal $S_n$ of the present frame is compared with a picture signal $S_{n-1}$ of a previous frame so as to generate a modification signal $S_n'$ and the modified picture signal $S_n'$ is supplied to each pixel. Here, the picture signal $S_n$ represents the data voltage in the case of analog driving methods. However, since binary gray codes are used to control the data voltage in digital driving methods, the actual modification of the voltage supplied to the pixel is performed by the modification of the gray signal.

First, if the picture signal (the gray signal or data voltage) of the present frame is identical with the picture signal of the previous frame, the modification is not performed.

Second, if the gray signal (or the data voltage) of the present frame is higher than that of the previous frame, a modified gray signal (data voltage) higher than the present gray signal (data voltage) is output, and if the gray signal (or the data voltage) of the present frame is lower than that of the previous frame, a modified gray signal (data voltage) lower than the present gray signal (data voltage) is output. At this time, the modification degree is proportional to the difference between the present gray signal (data voltage) and the gray signal (data voltage) of the previous frame.

A method for modifying the data voltage according to a preferred embodiment will now be described.

Figure 4:
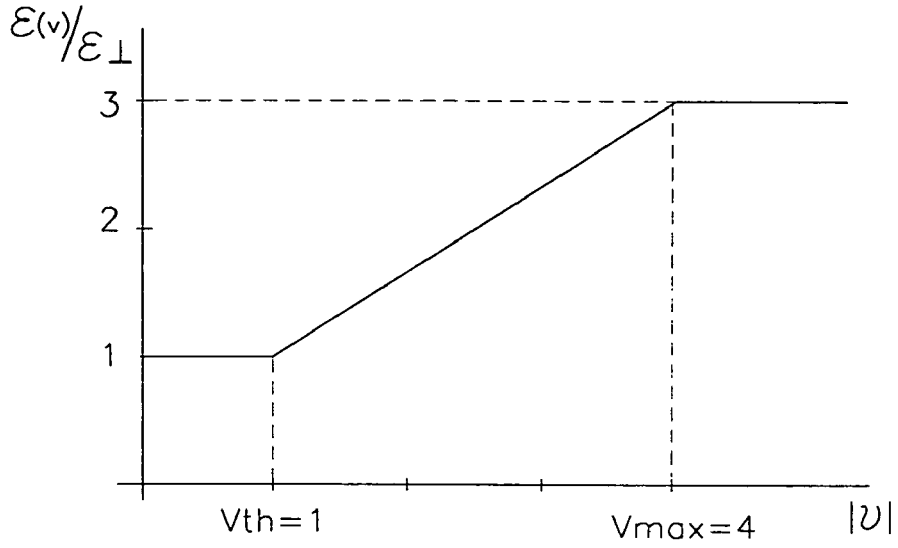
FIG. 4 shows a modeled relation between the voltage and permittivity of the LCD.

FIG. 4 shows a model exhibiting the relationship between the voltage and permittivity of the LCD.

As shown, the horizontal axis represents the pixel voltage. The vertical axis represents a ratio between the permittivity $\epsilon(v)$ at a certain level of pixel voltage v and the permittivity $\epsilon_\perp$ when the liquid crystal is arranged in parallel with the substrate; that is, when the liquid crystal lines perpendicular to the permeating direction of the light.

The maximum value of $\epsilon(v)/\epsilon_\perp$, that is, $\epsilon_{//}/\epsilon_\perp$ is assumed to be 3, $V_{th}$ to be 1 V, and $V_{max}$ to be 4V. Here, the $V_{th}$ and $V_{max}$ respectively represent the pixel voltages of the full white and full black (or vice versa).

When the capacitance of the storage capacitor (which will be referred to as the storage capacitance) is set to be identical to an average value $<C_l>$ of the liquid crystal capacitance, and the area of the LCD substrate and distance between the substrates are respectively set to be 'A' and 'd', the storage capacitance $C_{st}$ can be expressed as Equation 1.

$$C_{st}=<C_l>=(1/3)\cdot(\epsilon_{//}+2\epsilon_\perp)\cdot(A/d)=(5/3)\cdot(\epsilon_\perp\cdot A/d)=(5/3)\cdot C0 \quad \text{Equation 1}$$

where $C0=\epsilon_\perp\cdot A/d$.

Referring to FIG. 4, $\epsilon(v)/\epsilon_\perp$ can be expressed as Equation 2.

$$\epsilon(v)/\epsilon_\perp=(1/3)\cdot(2V+1) \quad \text{Equation 2}$$

Since total capacitance C(V) of the LCD is the sum of the liquid crystal and the storage capacitance, the capacitance C(V) can be expressed in Equation 3 from Equations 1 and 2.

$$\begin{aligned} C(V) &= C_l + C_{st} \\ &= \varepsilon(v)\cdot(A/d)+(5/3)\cdot C0 \\ &= (1/3)\cdot(2V+1)\cdot C0+(5/3)\cdot C0 \\ &= (2/3)\cdot(V+3)\cdot C0 \end{aligned} \quad \text{Equation 3}$$

Since the charge Q supplied to the pixel is preserved, the following Equation 4 is established.

$$Q=C(V_{n-1})\cdot V_n=C(V_f)\cdot V_f \quad \text{Equation 4}$$

where $V_n$ represents the data voltage (or, an absolute value of the data voltage of an inverting driving method) to be supplied to the present frame, $C(V_{n-1})$ represents the capacitance corresponding to the pixel voltage of the previous frame (that is, (n−1)th frame), and $C(V_f)$ represents the capacitance corresponding to the actual voltage $V_f$ of the pixel of the present frame (that is, n-th frame).

Equation 5 can be derived from Equations 3 and 4.

$$C(V_{n-1})\cdot V_n=C(V_f)\cdot V_f=(2/3)\cdot(V_{n-1}+3)\cdot V_n=(2/3)\cdot(V_f+3)\cdot V_f \quad \text{Equation 5}$$

Hence, the actual pixel voltage Vf can be expressed as Equation 6.

$$V_f=(-3+\sqrt{9+4V_n(V_{n-1}+3)})/2 \quad \text{Equation 6}$$

As clearly expressed in Equation 6, the actual pixel voltage $V_f$ is determined by the data voltage $V_n$ supplied to the present frame and the pixel voltage $V_{n-1}$ supplied to the previous frame.

If the data voltage supplied in order for the pixel voltage to reach the target voltage $V_n$ at the n-th frame is set to be $V_n'$, the data voltage $V_n'$ can be expressed as Equation 7 from Equation 5.

$$(V_{n-1}+3)\cdot V_n'=(V_n+3)\cdot V_n \quad \text{Equation 7}$$

Hence, the data voltage $V_n'$ can be expressed as Equation 8.

$$V_n'=\frac{V_{n+3}}{V_{n-1}+3}\cdot V_n=V_n+\frac{V_n-V_{n-1}}{V_{n-1}+3}\cdot V_n \quad \text{Equation 8}$$

As noted-above, when supplying the data voltage $V_n'$ obtained by the Equation 8 by the consideration of the target pixel voltage $V_n$ of the present frame and the pixel voltage $V_{n-1}$ of the previous frame, the pixel voltage can directly reach the target pixel voltage $V_n$.

Equation 8 is derived from FIG. 4 and a few assumptions, and the data voltage $V_n'$ applied to the general LCD can be expressed as Equation 9.

$$|V_n'|=|V_n|+f(|V_n|-|V_{n-1}|) \quad \text{Equation 9}$$

where the function $f$ is determined by the characteristics of the LCD. The function $f$ has the following characteristics.

That is, $f=0$ when $|V_n|=|V_{n-1}|$, $f>0$ when $|V_n|>|V_{n-1}|$, and $f<0$ when $|V_n|<|V_{n-1}|$.

A method for supplying the data voltage according to a first preferred embodiment of the present invention will now be described.

Figure 5:
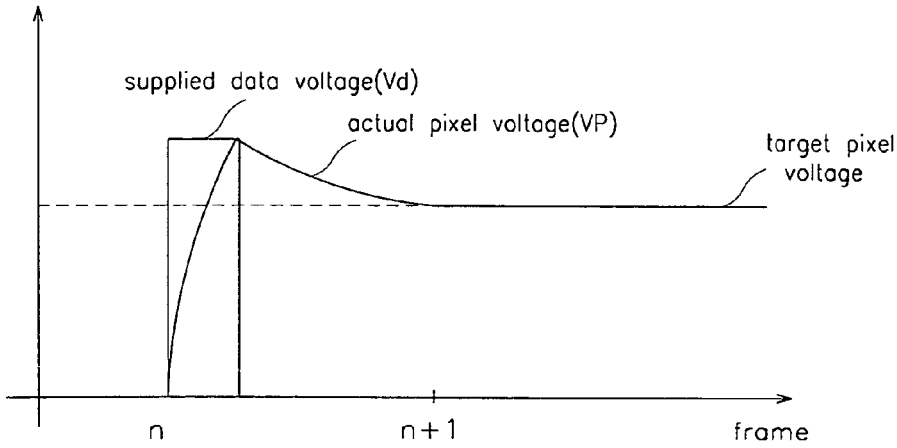
FIG. 5 shows a method for supplying the data voltage according to a first preferred embodiment of the present invention.

FIG. 5 shows the method for supplying the data voltage.

As shown in the first preferred embodiment, the data voltage $V_n'$ modified by the formula considering the target pixel voltage of the present frame and the pixel voltage (data voltage) of the previous frame is supplied, and the pixel voltage $V_p$ reaches the target voltage. In other words, when the target voltage of the present frame is different from the pixel voltage of the previous frame, the voltage higher (or lower) than the target voltage of the present frame is supplied as the modified data voltage so as to reach the target voltage level at the first frame, and after this, the target voltage is supplied as the data voltage at the following frames. This improves the response speed of the liquid crystal.

At this time, the modified data voltage (charges) is determined by considering the liquid crystal capacitance determined by the pixel voltage of the previous frame. That is, the charge Q is supplied by considering the pixel voltage level of the previous frame so as to directly reach the target voltage level at the first frame.

Figure 6:
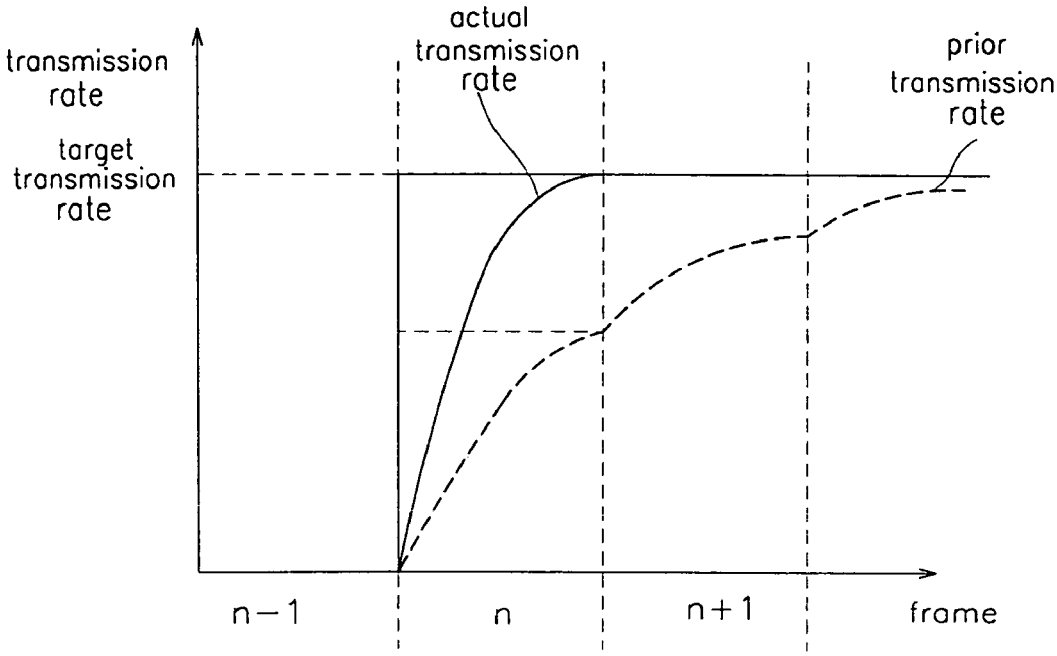
FIG. 6 shows a light transmission rate of the LCD when supplying the data voltage according to the first preferred embodiment of the present invention.

FIG. 6 shows a permittivity of the LCD in the case of supplying the data voltage according to the first preferred embodiment of the present invention. As shown, since the modified data voltage is supplied according to the first preferred embodiment, the permittivity directly reaches the target permittivity.

Figure 7:
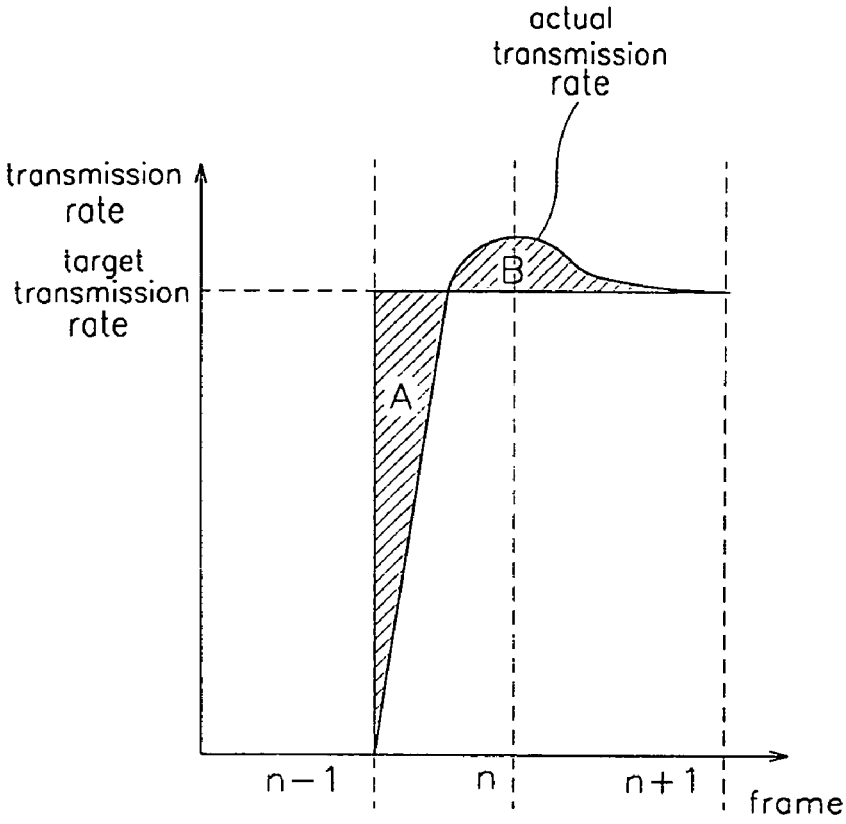
FIG. 7 shows a light transmssion rate of the LCD when supplying the data voltage according to a second preferred embodiment of the present invention.

In a second preferred embodiment, a modified voltage $V_n'$ a little higher than the target voltage is supplied the pixel voltage. As shown in FIG. 7, the permittivity becomes lower than the target permittivity before a half of the response time of the liquid crystal, but after this, the permittivity becomes overcompensated compared to the target value so that the average permittivity becomes equal to the target permittivity.

It is now described an LCD according to a preferred embodiment of the present invention.

Figure 8:
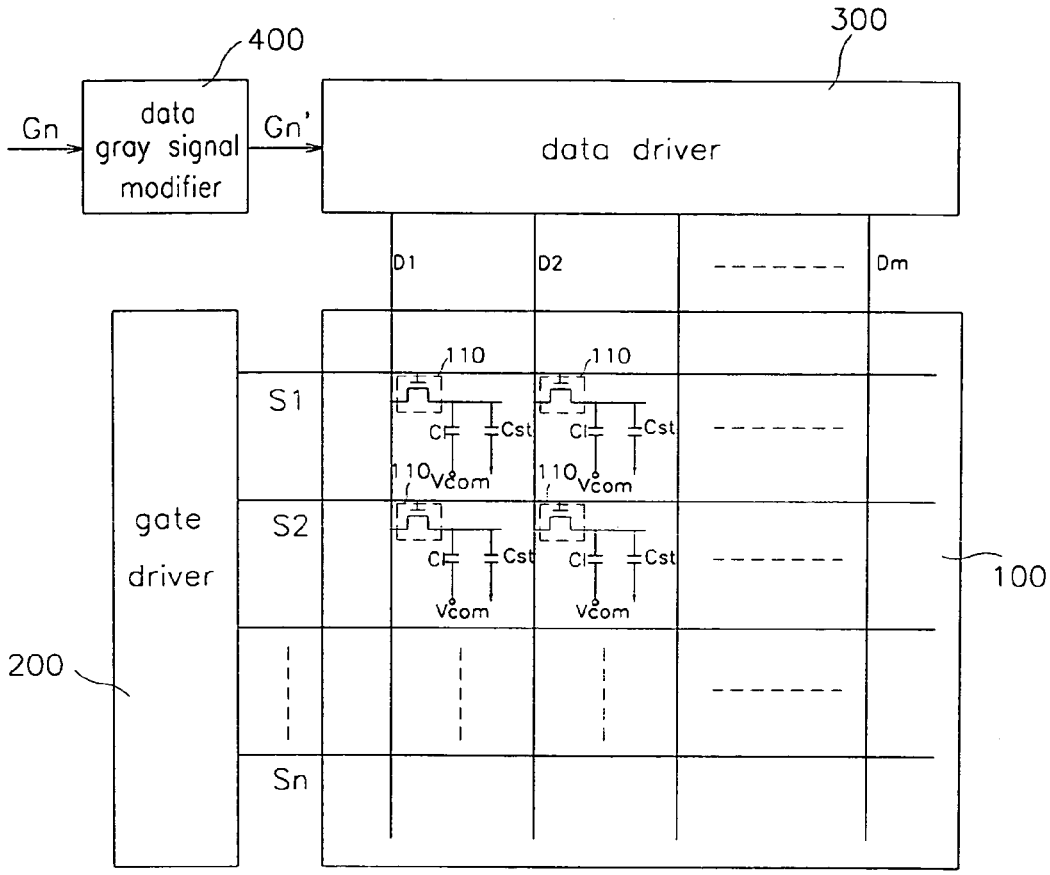
FIG. 8 shows an LCD according to the preferred embodiment of the present invention.

FIG. 8 shows an LCD according to the preferred embodiment of the present invention. The LCD according to the preferred embodiment uses a digital driving method.

As shown, the LCD comprises an LCD panel 100, a gate driver 200, a data driver 300 and a data gray signal modifier 400.

A plurality of gate lines S1, S2, . . . , Sn for transmitting gate ON signals, and a plurality of data lines D1, D2, . . . , Dn for transmitting the modified data voltages are formed on the LCD panel 100. An area surrounded by the gate lines and data lines forms a pixel, and the pixel comprises TFTs 110 having a gate electrode connected to the gate line and having a source electrode connected to the data line, a pixel capacitor C1 connected to a drain electrode of the TFT 110, and a storage capacitor $C_{st}$.

The gate driver 200 sequentially supplies the gate ON voltage to the gate lines so as to turn on the TFT having a gate electrode connected to the gate line to which the gate ON voltage is supplied.

The data gray signal modifier 400 receives n-bit data gray signals $G_n$ from a data gray signal source (e.g., a graphic signal controller), and outputs the m-bit modified data gray signals $G_n'$ after considering the m-bit data gray signals of the present and previous frames. At this time, the data gray signal modifier 400 can be a stand-alone unit or can be integrated into a graphic card or an LCD module.

The data driver 300 converts the modified gray signals $G_n'$ received from the data gray signal modifier 400 into corresponding gray voltages (data voltages) so as to supply the same to the data lines.

Figure 9:
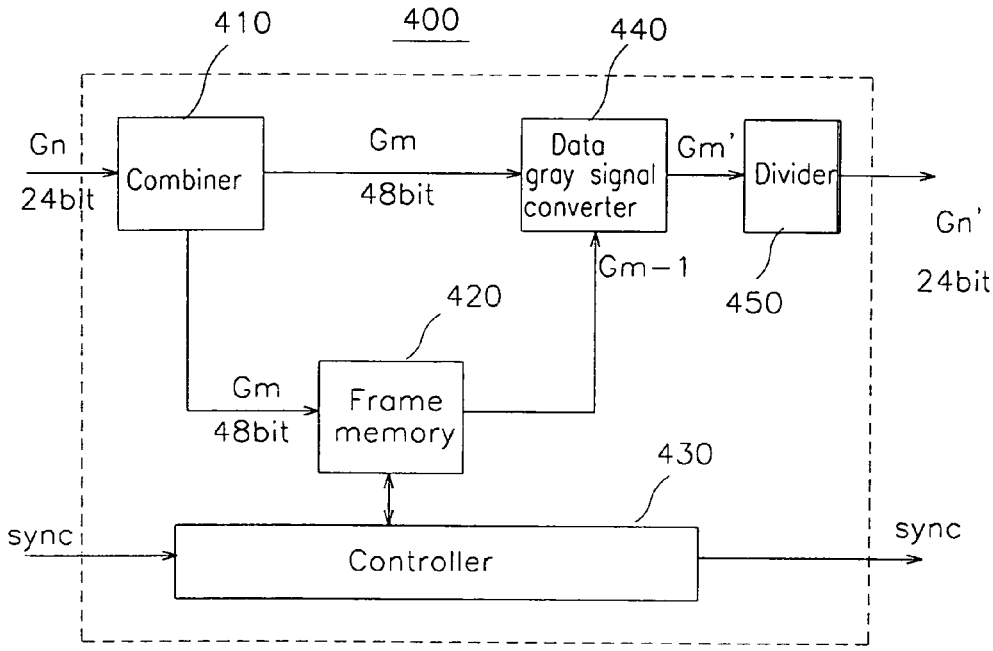
FIG. 9 shows a data gray signal modifier according to the preferred embodiment of the present invention.

FIG. 9 shows a detailed block diagram of the data gray signal modifier 400 of FIG. 8.

As shown, the data gray signal modifier 400 comprises a combiner 410, a frame memory 420, a controller 430, a data gray signal converter 440 and a divider 450. The combiner 410 receives gray signals from the data gray signal source, and converts the frequency of the data stream into a speed that can be processed by the data gray signal modifier 400. For example, if 24-bit data synchronized with the 65 MHz frequency are transmitted from the data gray signal source and the processing speed of the components of the data gray signal modifier 400 is limited within 50 MHz, the combiner 410 combines the 24-bit gray signals into 48-bit gray signals $G_m$ two by two and then transmits the same to the frame memory 420.

The combined gray signals $G_m$ output the previous gray signals $G_{m-1}$ stored in a predetermined address to the data gray signal converter 440 according to a control process by the controller 430 and concurrently stores the gray signals $G_m$ transmitted by the combiner 410 in the above-noted address. The data gray signal converter 440 receives the present frame gray signals $G_m$ output by the combiner and the previous frame gray signals $G_{m-1}$ output by the frame memory 420, and generates modified gray signals $G_m'$ by processing the gray signals of the present and previous frames.

The divider 450 divides 48-bit modified data gray signals $G_m'$ from the data gray signal converter 440 and outputs 24-bit modified gray signals $G_n'$.

In the preferred embodiment of the present invention, since the clock frequency synchronized to the data gray signal is different from that for accessing the frame memory 420, the combiner 410 and the divider 450 are needed, but in the case the clock frequency synchronized to the data gray signal is identical with that for accessing the frame memory 420, the combiner 410 and the divider 450 are not needed.

Any digital circuits that satisfy the above-defined equation 9 can be manufactured as the data gray signal converter 440.

Also, in the case a lookup table is made and stored in a read only memory (ROM), the gray signals can be modified by accessing the lookup table.

Since the modified gray voltage $V_n'$ is not only proportional to the difference between the data voltage $V_{n-1}$ of the previous frame and the $V_n$ of the present frame but also depends on their respective absolute values, the lookup table makes the circuit simpler compared to the computation process.

In order to modify the data voltage according to the preferred embodiment of the present invention, a dynamic range wider than the actually used gray scale range must be used. In the analog circuits, this problem can be solved using high voltage integrated circuits, but in the digital circuit, the number of the grays is restricted. For example, in the 6-bit gray case, a portion of the 64 gray levels has to be assigned not for the actual gray representation but for the modified voltage. That is, a portion of the gray level should be assigned for modification of the voltage, and hence the number of the grays to be represented is reduced.

In order to prevent the reduction of the number of the grays, a truncation concept can be introduced. For example, it is assumed that the voltage from 0 to 8V is necessary when the liquid crystal is activated at voltage from 1 to 4V and a modification voltage is considered. At this time, when dividing the voltage having the range from 0 to 8V into 64 levels in order to perform a full modification, the number of the grays which can be actually represented becomes about 30 at most. Therefore, in the case the range of the voltage becomes 1 to 4V and the modified voltage $V_n'$ becomes greater than 4V, the number of the grays can be reduced if truncating all the modification voltages to 4V.

FIG. 10 shows a configuration of the lookup table using the concept of the truncation according to the preferred embodiment of the present invention.

In the preferred embodiments of the present invention, the LCD driven by a digital method is described, and also the present invention can be applied to the LCD driven by an analog method.

In this case, a data gray signal modifier that functions corresponding to the data gray signal modifier as described in FIG. 8 is needed, and this data gray signal modifier can be implemented using an analog circuit that satisfies the equation 9.

As described above, the pixel voltage reaches the target voltage level as the data voltage is modified and the modified data voltage is provided to the pixels. Therefore, the configuration of the TFT LCD panel does not have to be changed and the response time of the liquid crystal can be improved.

Figure 11:
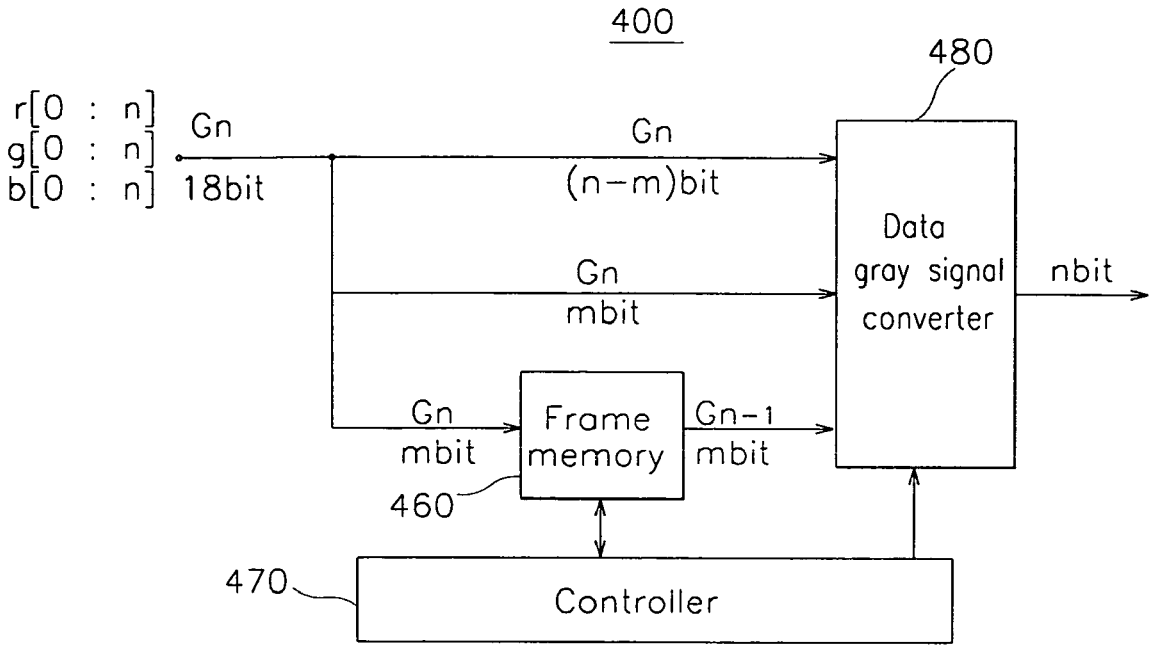
FIG. 11 shows a data gray signal modifier according to a second embodiment of the present invention.

FIG. 11 shows a detailed block diagram of the data gray signal modifier 400 according to a second preferred embodiment of the present invention.

As shown, the data gray signal modifier 400 comprises a frame memory 460, a controller 470 and a data gray signal converter 480, and receives n-bit gray signals of the respective red (R), green (G) and blue (B) from the data gray signal source. Therefore, the total number of bits of the gray signals transmitted to the data gray signal converter 480 becomes (3×n) bits. Here, a skilled person can make either the (3×n)-bit gray signals be concurrently supplied to the data gray signal modifier 480 from the data gray signal source, or make the respective n-bit R, G and B gray signals be sequentially supplied to the same.

Referring to FIG. 11, the frame memory 460 fixes the bit of the gray signal to be modified. The frame memory 460 receives m bits of the n-bit R, G and B gray signals from the data gray signal source, stores the same in predetermined addresses corresponding to the R, G and B, and outputs the same to the data gray signal converter 480 after a single frame delay. That is, the frame memory 460 receives the m-bit gray signals $G_n$ of the present frame and outputs m-bit gray signals $G_{n-1}$ of the previous frame.

The data gray signal converter 480 receives (n−m) bits of the present frame $G_n$ which are passed through without modification, m bits of the present frame received for modification, and m bits of the previous frame $G_{n-1}$ delayed by the frame memory 460, and then generates the modified gray signals $G_n'$ by considering the m bits of the present and previous frames.

Figure 12:
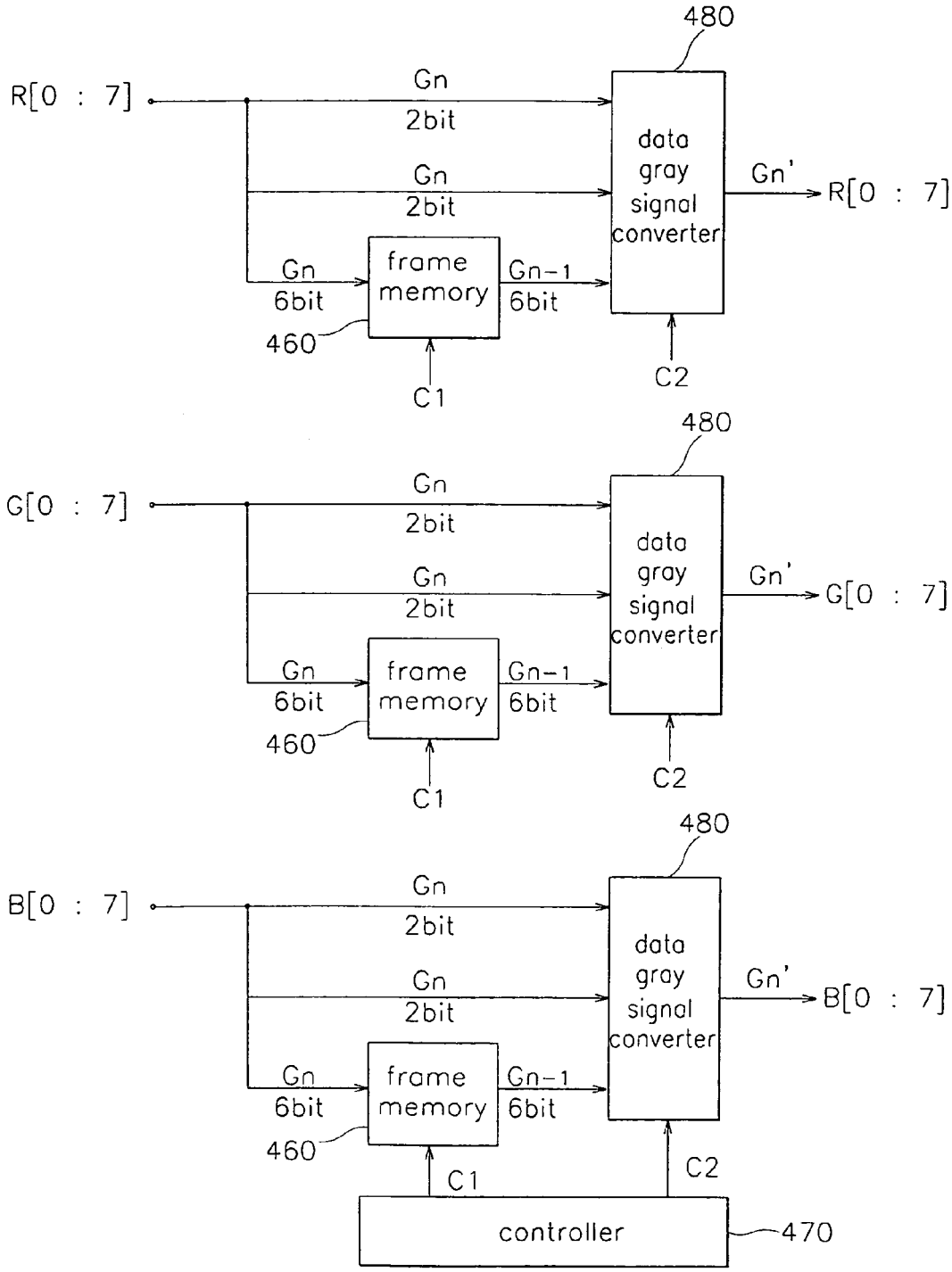
FIG. 12 conceptually shows an operation of the data gray signal modifier according to the first preferred embodiment of the present invention shown in FIG. 11.

The above-noted description will now be further provided, with reference to FIG. 12.

FIG. 12 conceptually shows an operation of the data gray signal modifier according to the first preferred embodiment of the present invention. It is assumed that the R, G and B gray signals transmitted to the data gray signal modifier 400 from the data gray signal source are respectively 8-bit signals.

Two bits (bits of the present frame) starting from the LSB among 8-bit gray signals transmitted to the data gray signal modifier 400 are not modified, and they are input to the data gray signal converter 480. The remaining 6 bits of the present frame are input to the data gray signal converter 480 for modification and concurrently stored in predetermined addresses of the frame memory 460.

Here, since the frame memory 460 stores the bit of the present frame during a single frame period and then outputs the same, 6-bit gray signals of the previous frame are output to the data gray signal converter 480.

The data gray signal converter 480 receives 6-bit R gray signals of the present frame and 6-bit R gray signals of the previous frame, generates modified gray signals considering the 6-bit R gray signals of the previous and present frames, adds the generated 6-bit gray signals and the 2-bit LSB gray signals of the present frame, and outputs finally modified 8-bit gray signals $G_n'$.

In the same manner as with the R gray signals, the data gray signal converter 480 outputs modified 8-bit G and B gray signals considering the 6-bit gray signals of the present and previous frames. The 8-bit modified gray signals are converted into corresponding voltages by a data driver and supplied to the data lines.

Here, the 6-bit R, G and B gray signals are stored in the established addresses of the frame memory 460. A skilled person can use a single frame memory 460 to assign the addresses for covering the R, G and B, or use three frame memories for the respective R, G and B to function as a single frame.

Through the description referred to in FIG. 12, when 8-bit gray signals are input from the data gray signal source, the prior frame memory stores 8-bit R, G and B gray signals in the case of SXGA (1,280×1,024), and therefore at least 30 Mb memories are necessary, but the frame memory 460 according to the preferred embodiment of the present invention only stores 6-bit gray signals, thereby reducing memory capacity needed.

Here, the less the number of the bits of the gray signals stored in the frame memory 460 becomes, the less capacity of the frame memory 460 becomes necessary.

An operation of the data gray signal modifier according to the second preferred embodiment will now be described.

Figure 13:
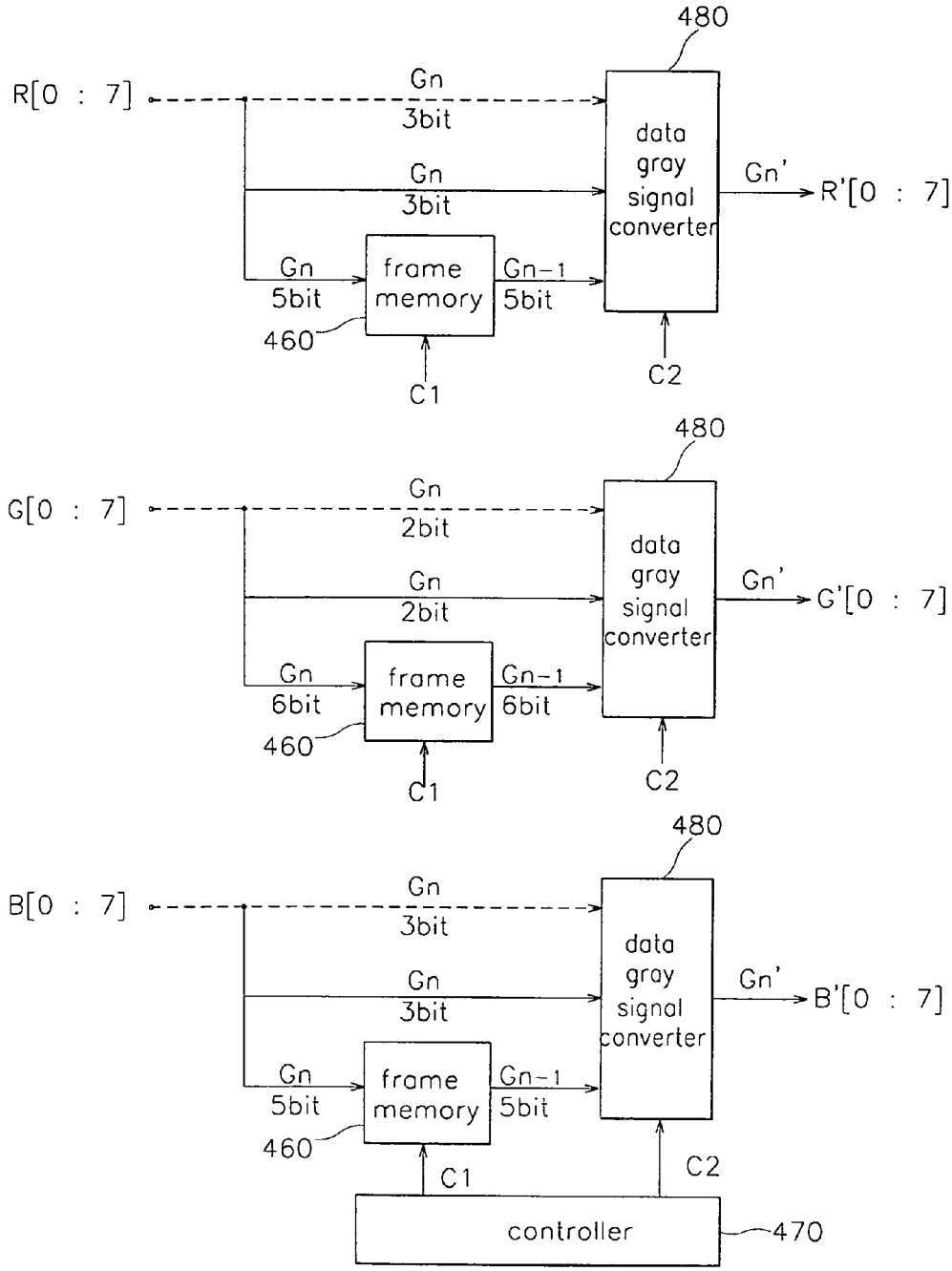
FIG. 13 conceptually shows an operation of the data gray signal modifier according to the second preferred embodiment of the present invention shown in FIG. 11.

FIG. 13 conceptually shows an operation of the data gray signal modifier according to the second preferred embodiment of the present invention. For easy understanding, the data gray signal modifier is designed using one frame memory and one data gray signal converter. However, the number of the frame memories and the data gray signal converters can be changed according to grades of the LCD panels, the bit number of the gray signals, and designer's intention. For example, three memories for configuring the frame memory and the data gray signal converter can be used to process R, G and B.

A skilled person can configure the frame memory by using first and second memories for processing reading and writing processes corresponding to the respective R, G and B gray signals so as to enhance data processing speed.

That is, when the gray signals are sequentially input to the frame memory, odd-numbered gray signals are stored in the first memory, and even-numbered gray signals are stored in the second memory, and when the odd-numbered gray signals are stored in the first memory, the second memory reads the first memory, and when the even-numbered gray signals are stored in the second memory, the first memory reads the second memory so that the data can be written/read to and from the frame memory within a shorter time.

In FIG. 13, the configuration of the data gray signal modifier 400 is similar to that of the first preferred embodiment. However, the data gray signal modifier 400 of the second preferred embodiment is different from the first preferred embodiment because the data gray signal modifier 400 of the second preferred embodiment reduces the bit number of the output gray signals compared to the bit number of the input gray signals. An operation of the data gray signal modifier 400 will now be described.

When the 8-bit R, G and B gray signals are provided by the data gray signal source, the lower 3 bits of the 8-bit R gray signals are not modified and are passed though the dotted line in the figure, and the remaining 5 bits of the present frame are input to the data gray signal converter 480 and the frame memory 460.

The 5-bit R gray signals of the present frame input to the frame memory 460 are stored in predetermined addresses and then output at the next frame, and 5-bit R gray signals of the previous frame are output to the data gray signal converter 480. The data gray signal converter 480 then receives the 5-bit R gray signals of the present and previous frames $G_n$ and $G_{n-1}$, generates the modified gray signals $G_n'$ proportional to the differences between the gray signals of the present and previous frames, and outputs the same. At this time, the modified R gray signals $G_n'$ are 8-bit signals obtained by an addition of the modified 5 bits and the unmodified 3 bits.

Two bits of the 8-bit G gray signals are passed via the dotted line, and remaining 6-bit gray signals $G_n$ are input to the data gray signal converter 480 and the frame memory 460. Here, the frame memory 460 stores the 6-bit G gray signals of the present frame in a predetermined address, and outputs the 6-bit G gray signals of the previous frame $G_{n-1}$. Therefore, the data gray signal converter 480 outputs the modified gray signals $G_n'$ using the 6-bit G gray signals of the present and previous frames. At this time, the modified G gray signals $G_n'$ are obtained by an addition of the modified 6 bits and unmodified 2 bits.

Finally, 3 bits of the 8-bit B gray signals are passed via the dotted line, and remaining 5-bit gray signals $G_n$ are input to the data gray signal converter 480 and the frame memory 460. Here, the frame memory 460 stores the 5-bit G gray signals of the present frame in a predetermined address and outputs the 5-bit G gray signals of the previous frame $G_{n-1}$. Hence, the data gray signal converter 480 outputs modified gray signals $G_n'$ by using the 5-bit G gray signals of the present and previous frames. At this time, the modified G gray signals $G_n'$ are 8 bits obtained by an addition of the modified 5 bits and unmodified 3 bits.

As described above, it is preferable that the passed bits among the 8-bit R, G and B gray signals start from the LSB, and a skilled person in the art can change the number of the passed bits. Hence, the skilled person in the art can change the capacity and number of the frame memories and modify the data gray signal converter.

A digital circuit that satisfies Equation 9 can be manufactured as the data gray signal converter 480 according to the preferred embodiment, or a look-up table is made and then stored into a read only memory (ROM), and accessed to modify the gray signals. Since the modified data voltage $V_n'$ is not only proportional to the difference between the data voltage $V_{n-1}$ of the previous frame and the data voltage $V_n$ of the present frame, but is also dependent on absolute values of the data voltages, the look-up table makes the configuration of the circuit simpler than the computation.

Referring to FIGS. 12 and 13, an example in which an LCD panel is the SXGA (1,280×1,024) type and 8-bit gray signals are supplied, will now be described.

Conventionally, in this case, the frame memory requires at least 30 Mb. The data gray signal converter requires 512 Kb×6 when processing two R, G and B pixels per one clock from the controller 470. And it requires 512 Kb×3 when processing one R, G and B pixel per one clock signal.

In detail, when processing two pixels per clock signal, the data gray signal modifier 400 receives 48-bit signals. Since the bus size of the memory is configured as×4, ×8, ×16 and×32, the 48-bit bus is configured using three 16-bit wide memories.

However, since only the bits from the LSB to the i-th bit (i=1, 2, . . . , n−1) among the n bits are modified and the remaining parts are not modified in the preferred embodiment of the present invention, the capacity of the frame memory and the data gray signal converter can be reduced.

For example, when n=8 and i=2, since six MSBs are to be modified and the remaining two bits do not have to be modified, the frame memory only needs 1,280×1,024×6 bits=22.5 Mb. Since the data gray signal converter can use six bits instead of an 8-bit gray table memory (512 Kb), the size is greatly reduced to 24 Kb in the case of one pixel per clock signal, and reduced to 6×24 Kb in the case of two pixels per clock signal.

In the preferred embodiment, a number of modification bits are omitted when modifying the gray signals since human eyes are not as sensitive to moving pictures as to still pictures. Therefore, it is desirable to omit modification bits up to the number where the human eyes cannot discern the variation of the gray signals of the moving pictures.

Since human eye has different sensitivities with respect to R, G and B, it is desirable to differently omit the number of modification bits with respect to the gray signals of the corresponding color. In other words, human eyes are most sensitive to green and least sensitive to blue. Thus, it is desirable that the number of modification bits 'i' be in the order of G≦R≦B.

According to the present invention, the data voltage is modified and the modified data voltage is supplied to the pixels so that the pixel voltage reaches the target voltage level. Hence, the response speed of the liquid crystal can be improved without changing the configuration of the TFT-LCD panel.

Further, since only 'm' bits out of n-bit gray signals are used, the number and capacity of the memory necessary for modifying the data voltage can be reduced, thereby increasing yield of the panels and reducing the cost.

As described above, an image signal modification circuit for improving the response speed of the liquid crystal is shown in FIGS. 9 and 11.

Particularly, in order to reduce the cost of the image signal modification circuit, the gray signals except a portion of the LSB are modified, and this algorithm is simple and easy to apply.

However, in the case of modifying four bits of the 8-bit gray, such quantization may cause two problems.

It is assumed that DCC modification value 168 (10101000) gray level ($G_n'$) maximizes the response speed, when 208 (11010000) gray level ($G_{n-1}$) changes to 192 (11000000) gray level ($G_n$). A modification of the full 8 bits generates no problem. However, a modification of MSB 4 bits so as to reduce the cost cannot provide a room for the value 168 in the lookup table. Instead, the value of 176 (10110000) or 160 (10100000) is input to the lookup table. That is, modification errors are generated as much as the omitted LSB bits. This can generate a greater problem in the following interval.

TABLE 1

| | | Gn−1 | | | | | | | | | | | | | | | | |
|---|---|---|---|---|---|---|---|---|---|---|---|---|---|---|---|---|---|---|
| Gn' | | 1 | 16 | 32 | 48 | 64 | 80 | 96 | 112 | 128 | 144 | 160 | 176 | 192 | 208 | 224 | 240 | 255 |
| Gn | 32 | 33 | 33 | 32 | 30 | 28 | 26 | 24 | 22 | 20 | 16 | 12 | 9 | 9 | 9 | 0 | 0 | 0 |

In this interval, the bits are modified gradually. Configuring this interval using only 4 bits, it becomes as follows.

TABLE 2

| | | Gn−1 | | | | | | | | | | | | | | | | |
|---|---|---|---|---|---|---|---|---|---|---|---|---|---|---|---|---|---|---|
| Gn' | | 0 | 16 | 32 | 48 | 64 | 80 | 96 | 112 | 128 | 144 | 160 | 176 | 192 | 208 | 224 | 240 | 255 |
| Gn | 32 | 32 | 32 | 32 | 32 | 32 | 32 | 32 | 16 | 16 | 16 | 16 | 16 | 0 | 0 | 0 | 0 | 0 |

The second problem is as follows.

Like the previous example, it is assumed that a modification value be 176 gray level when the 208 gray level is switched to the 192 gray level. Then, 176 or 175 gray level must be provided to obtain a maximum liquid crystal response speed when the 207 gray level is switched to the 192 gray level.

However, when modifying only 4 bits, since the MSB 4 bits of 207 (11001111) is identical with that of 192 (11000000), the modification is not performed and the 192 is output.

Particularly, in moving pictures, 209 and 207 gray levels are distributed on a uniform screen of about 208 gray level. Thus, although the difference of gray level 1 between the 208 and 207 gray levels may exaggerate the display defects, as the compensation difference widens.

These problems are referred to as the quantization errors. As the number of the omitted LSBs increases the quantization errors become serious.

An LCD for reducing the quantization errors will now be described.

Figure 14:
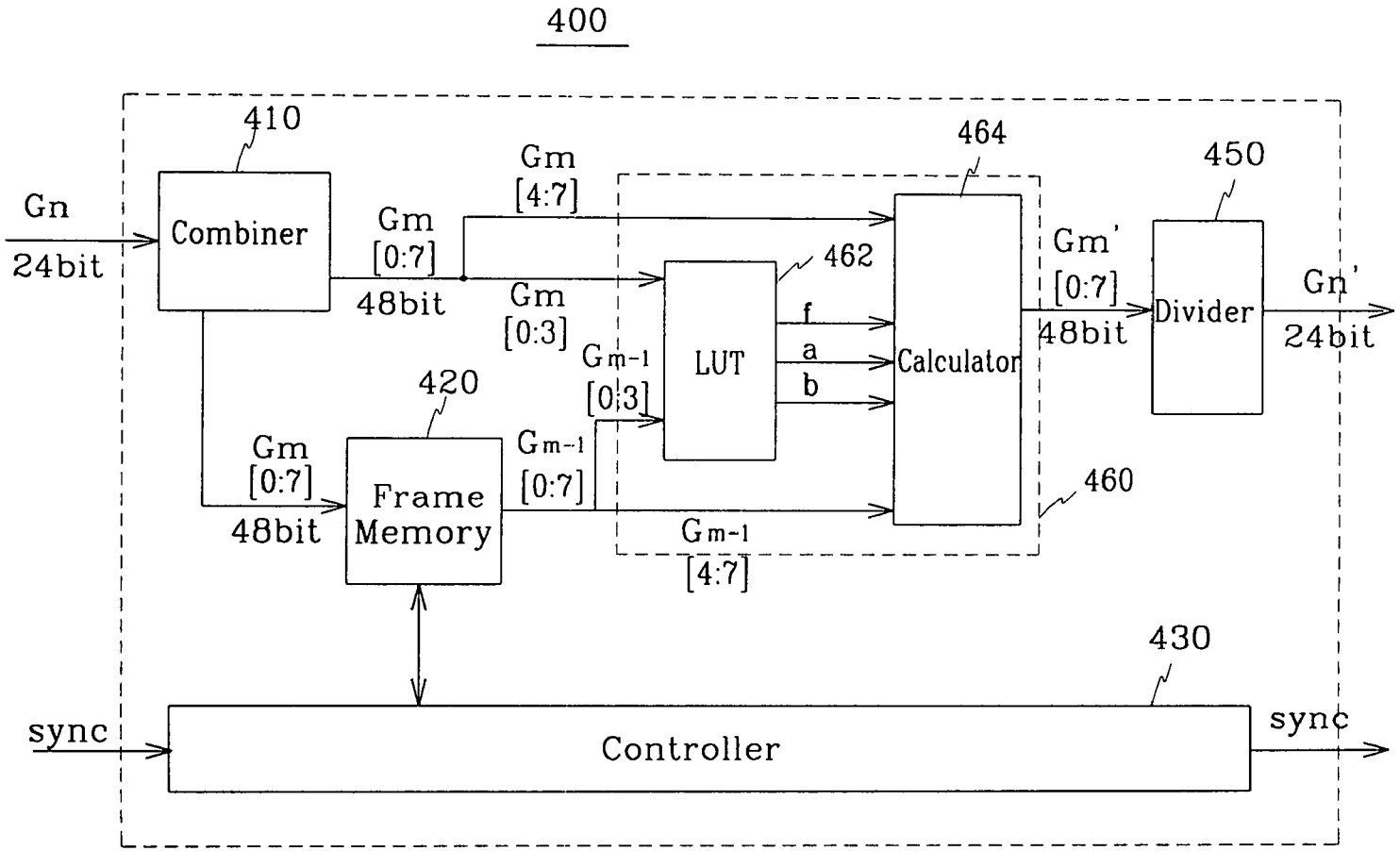
FIG. 14 shows a data gray signal modifier according to a third embodiment of the present invention.

FIG. 14 shows a data gray signal modifier according to a third embodiment of the present invention. The same portions compared to FIG. 9 will be assigned with identical reference numerals and no further description will be provided.

Referring to FIG. 14, the data gray signal converter 460 of the data gray signal modifier comprises a lookup table 462 and a calculator 464.

As the combiner 410 provides MSB 4-bit gray data $G_m[0:3]$ of the present frame and MSB 4-bit gray data $G_{m-1}[0:3]$ of the previous frame, the values f, a and b stored in the lookup table are extracted and provided to the calculator 464.

The calculator 464 receives the LSB 4-bit gray data $G_m[4:7]$ of the present frame from the combiner 410, the LSB 4-bit gray data $G_{m-1}[4:7]$ of the previous frame from the frame memory 420, the variables f, a and b to modity the moving pictures from the lookup table. Then it performs a predetermined computation and outputs first modified gray data $G_m'[0:7]$ to the divider 450.

The first modified 36-bit gray data provided to the divider 450 are divided, and the modified 24-bit gray data $G_n'$ are output to the data driver 300.

In the preferred embodiments of the present invention as shown in FIG. 8, the LCD driven by a digital method is described, and also the present invention can be applied to the LCD driven by an analog method.

According to a second preferred embodiment of the present invention, reduction of the quantization errors will now be described in detail.

First, if the total gray levels are set to be x bits, the MSB y bits of the x bits are modified using the gray lookup table and the remaining z bits, that is (x−y) bits are modified by computation.

An example will now be described when x=8 and y=4.

For ease of explanation, the following will be defined. [A]n is a multiple of the maximum $2^n$ not greater than A. For example, $[207]_4=[206]_4=[205]_4= \ldots =[193]_4=[192]_4=192$.

In other words, $[A]_n$ is a value representing that n of the LSBs in A are all zeros. On the otherhand, ${}_m[A]$ is a value representing that m of the MSBs in A are all zeros. And ${}_m[A]_n$ is a value representing that n of the LSBs and m of the MSBs in A are all zeros. When a mapping according to the gray lookup table for modification is set to be $f(G_n, G_{n-1})$, the modification of the present invention is as follows.

$$G_n' = f([G_n]_4, [G_{n-1}]_4) + a([G_n]_4, [G_{n-1}]_4) \cdot \frac{4[G_n]}{16} - b([G_n]_4, [G_{n-1}]_4) \cdot \frac{4[G_n]}{16} \qquad \text{Equation 10}$$

where a and b are positive integers.

According to the equation 10, the quantization errors can be reduced by using the gray lookup table.

The f, a and b are given as follows.

$$f([G_n]_4, [G_{n-1}]_4) = G_n'([G_n]_4, [G_{n-1}]_4)$$

$$a([G_n]_4, [G_{n-1}]_4) = G_n'([G_n]_4+16, [G_{n-1}]_4) - G_n'([G_n]_4, [G_{n-1}]_4)$$

$$b([G_n]_4, [G_{n-1}]_4) = G_n'([G_n]_4, [G_{n-1}]_4) - G_n'([G_n]_4, [G_{n-1}]_4+16)$$

It is assumed that a gray lookup table for modification is obtained as shown in Table 3.

TABLE 3

| | Gn' | Gn−1 | |
|---|---|---|---|
| | | 64 | 80 |
| Gn | 128 | 140 | 136 |
| | 144 | 160 | 158 |

For example, if it is set that $[G_n]_4=128$ and $[G_{n-1}]4=64$, then it becomes that $f([G_n]_4,[G_{n-1}]_4)=140$, $a([G_n]_4,[G_{n-1}]_4)=160-140=20$, and $b([G_n]_4,[G_{n-1}]_4)=140-136=4$. However, these values are not fixed and may be adjusted so that the values in the 16×16 interval can be approximated with minimal errors.

For example, when approximating the case of $G_n=144$ and $G_{n-1}=80$ by using the equation 10, $Gn'=140+20\times16/16-4\times16/16=156$. the value is different from the actually measured value 158. This error can be ignored, but if the error becomes greater, the error of the values in the 16×16 interval can be minimized by precisely adjusting the values of f, a and b.

An exceptional case is a block of $[G_n]_4=[G_{n-}]_4$. In this case, since $G_n'=G_n$ must be sustained valid, $f=[G_n]_4$ is fixed and the values of a and b are adjusted according to the states. If $G_n=G_{n-1}$ in the equation 10, to satisfy $G_n'=G_n$.

Following is an example to describe the modified gray data computed using the equation 10.

Figure 15A:
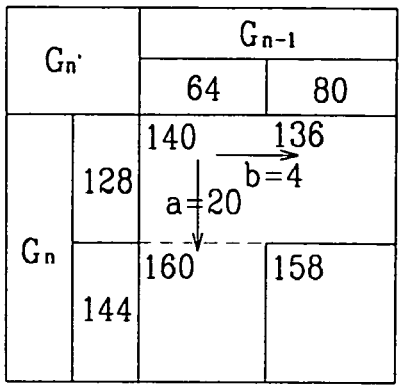
FIGS. 15(*a*) to 15(*c*) show a conversion process of the modified gray data computed according to the third preferred embodiment of the present invention.
Figure 15B:
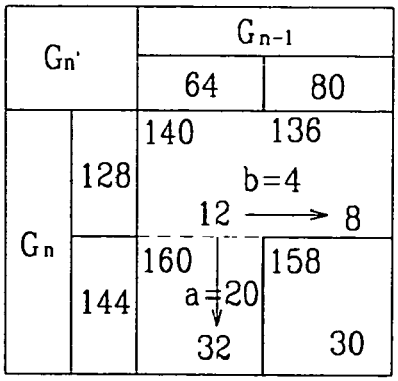
Figure 15C:
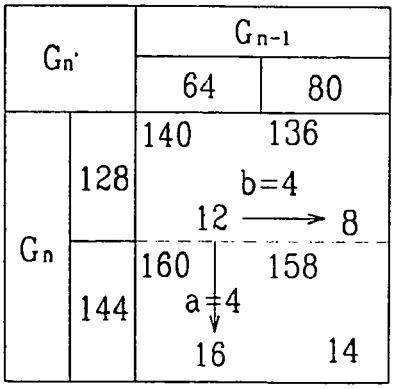
Figure 16:
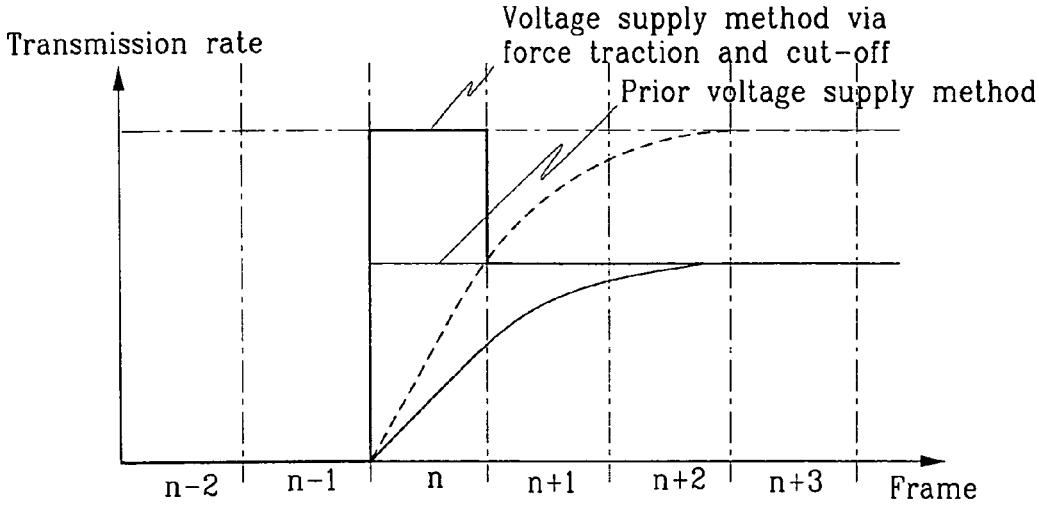
FIG. 16 shows a waveform diagram for comparing the conventional voltage supply method with that according to the preferred embodiment of the present invention.

Let's assume that a previous gray data $G_{n-1}$ is a 72 gray level and a present gray data $G_n$ is a 136 gray level. The gray lookup table of the table 3 does not have the above-noted gray data. Thus, these values must be obtained by a predetermined computation as shown in FIG. 15(*a*).

That is, since $f([G_n]_4,[G_{n-}]_4)=f([136]_4,[72]_4)$, it is satisfied that $f(128,64)=140$, $a([G_n]_4,[G_{n-}]_4)=160-140=20$ and $b([G_n]_4,[G_{n-1}]_4)=140-136=4$.

Hence, when putting the values in the equation 10, it becomes that $G_n'=140+20x(136-128)/16-4x(72-64)/16=148$.

Also, in order to reduce the number of the bits stored in the lookup table, equation 11 can be used.

$$G_n' = f' + [G_n]_4 + a\cdot([G_n]_4, [G_{n-1}]_4)\cdot \frac{{}_4[G_n]}{16} - b\cdot([G_n]_4, [G_{n-1}]_4)\cdot\frac{{}_4[G_n]}{16} \quad \text{Equation 11}$$

where it is defined that $f'=f([G_n]_4,[G_{n-1}]_4)-[G_n]_4$, and a and b are positive integers.

Following is an example to describe the modified gray data computed using the equation 11.

Like the previous example, lets assume that a previous gray data $G_{n-1}$ is a 72 gray level and a present gray data $G_n$ is a 136 gray level. Since the gray lookup table of the table 3 does not have the above-noted gray data, these values must be obtained by a predetermined computation as shown in FIG. 15(*b*).

That is, $f'=f([G_{n]4},[G_{n-1}]_4)-[G_n]_4=f([136]_4,[72]_4)-128=f(128,64)-128=140-128=12$, $a''([G_n]_4,[G_{n-1}]_4)=a'([G_n]_4,[G_{n-1}]_4)+2^4=4+16=20$ and $b([G_n]_4,[G_{n-1}]_4)=4$.

Hence, when putting the values in the equation 11, it becomes that $G_n'=128+12+20\times(136-128)/16-4\times(72-64)/16=148$.

In order to reduce the number of the bits stored in the lookup table, equation 12 can also be used.

$$G_n' = f'([G_n]_4, [G_{n-1}]_z) + G_n + a'\cdot([G_n]_4, [G_{n-1}]_4)\cdot \frac{{}_4[G_n]}{16} - b\cdot([G_n]_4, [G_{n-1}]_4)\cdot\frac{{}_4[G_n]}{16} \quad \text{Equation 12}$$

where it is defined that $f'=f-G_n$, and the value a' is an integer, and the value b is a positive integer.

That is, it becomes that $a'([G_n]_4,[G_{n-1}]_4)=a([G_n]_4,[G_{n-1}]_4)-2^4$.

An example will be described in order to describe the modified gray data computed using the equation 12.

Let's assume that a previous gray data $G_{n-1}$ is a 72 gray level and a present gray data $G_n$ is a 136 gray level. Since the gray lookup table of the table 3 does not have the above-noted gray data, these values must be obtained by a predetermined computation as shown in FIG. 15(*b*).

That is, since $f([G_n]_4,[G_{n-1}]_4)=f([136]_4,[72]_4)=f(128,64)=140$, it is satisfied that $f'=f([G_n]_4,[G_{n-1}]_4)-G_n=140-128=12$, $G_n=136$, $a'([G_n]_4,[G_{n-1}]_4)=a'-16=4$ and $b([G_n]_4,[G_{n-1}]_4)=4$.

Hence, when putting the values in the equation 12, it becomes that $G_n'=132+12+4\times(136-128)/16-4\times(72-64)/16=148$.

In this case, since the value of a' becomes smaller, the number of the bits assigned to (−16)a' can be reduced, but a' can be negative number in some intervals, and accordingly, an additional sign bit must be assigned.

As described above, the size of the lookup table for the modified gray data decreases in the order of equation 10, equation 11 and equation 12, but the logic complication increases on the contrary.

The above examples describe modifications of 8 bits.

However, all the 8-bit data may not be stored when the capacity of the frame memory or the number of input/output pins should be reduced.

For example, since dimensions of a DRAM include ×4, ×8, ×16 and ×32, the dimension of ×32 should be used so as to store 24-bit color information of the respective R, G and B, but it costs a lot. Instead of the dimension of ×32, a dimension of ×16 can be used, and 5-bit R, 6-bit G and 5-bit G can only be stored. The gray values cn be modified as follows.

That is, in the case of 6 bits, the modification gray values are output as follows.

$$G_n' = f([G_n]_4, [G_{n-1}]_4) + a\cdot([G_n]_4, [G_{n-1}]_4)\cdot \frac{{}_4[G_n]}{16} - b\cdot([G_n]_4, [G_{n-1}]_4)\cdot\frac{{}_4[G_n]\gg 2}{4} \quad \text{Equation 13}$$

where $[G_n]_4$ represents that zeros are provided to all the LSB 4 bits of $G_n$, and $[G_{n-1}]_4$ represents that zeros are provided to all the LSB 4 bits of $G_{n-1}$, and ${}_4[G_n]$ represents that zeros are provided to all the MSB 4 bits of $G_n$, and the values of a and b are positive integers, and ${}_4[G_n]>>2$ functions such that binary data of the computed ${}_4[G_n]$ are shifted in the right direction by 2 bits, and as a result, it functions as divided by $2^2$.

Also, in the case of 5 bits, the gray values are modified as follows.

$$G'_n = f([G_n]_4, [G_{n-1}]_4) + a\cdot([G_n]_4, [G_{n-1}]_4)\cdot \frac{{}_4[G_n]}{16} - b\cdot([G_n]_4, [G_{n-1}]_4)\cdot \frac{{}_4[G_n] \gg 3}{2} \quad \text{Equation 14}$$

where it is defined that $[G_n]_4$ represents that zeros are provided to all the LSB 4 bits of $G_n$, and $[G_{n-1}]_4$ represents that zeros are provided to all the LSB 4 bits of $G_{n-1}$, and ${}_4[G_n]$ represents that zeros are provided to all the MSB 4 bits of $G_n$, and the values of a and b are positive integers, and ${}_4[G_n]>>3$ functions such that binary data of the computed ${}_4[G_n]$ are shifted in the right direction by 3 bits, and as a result, it functions as divided by $2^3$.

According to the resolution of the display, the pixel frequency may increase, rendering the high speed computation difficult. In such a case, the gray data $G_n$ of the present frame can be modified omitting some LSBs. When modifying respective 6 bits of $G_n$ and $G_{n-1}$, the conversion is as follows.

$$G'_n = f([G_n]_4, [G_{n-1}]_4) + a\cdot([G_n]_4, [G_{n-1}]_4)\cdot \frac{{}_4[G_n] \gg 2}{4} - b\cdot([G_n]_4, [G_{n-1}]_4)\cdot \frac{{}_4[G_n] \gg 2}{4} \quad \text{Equation 15}$$

As described above, a gray lookup table of p bits is used, and in the case of modifying only q-bit Gn and r-bit Gn−1, it is as follows (q, r>p.)

$$G'_n = f([G_n]_{8-p}, [G_{n-1}]_{8-p}) + a\cdot([G_n]_{8-p}, [G_{n-1}]_{8-p})\cdot \frac{{}_p[G_n]_{8-p} \gg (8-q)}{2^{(q-p)}} - b\cdot([G_n]_{8-p}, [G_{n-1}]_{8-p})\cdot \frac{{}_p[G_n]_{8-r} \gg (8-r)}{2^{(r-p)}} \quad \text{Equation 16}$$

An operation of an LCD having a function of a moving picture modification will now be described.

As described above, in order to eliminate the lagging in moving pictures, image signals $G_n$ of a frame are modified compared to the image signals $G_{n-1}$ of a previous frame and using the equations 17 through 20.

$$G_n' = G_n, \text{ if } G_n = G_{n-1} \quad \text{Equation 17}$$

$$G_n' > G_n, \text{ if } G_n > G_{n-1} \quad \text{Equation 18}$$

$$G_n' < G_n, \text{ if } G_n < G_{n-1} \quad \text{Equation 19}$$

$$G_n' - G_n \propto G_n - G_{n-1} \quad \text{Equation 20}$$

When the image signals provided by the present frame are identical to those of the previous frame, no modification is necessary as shown in Equation 17. When the present gray signal (or gray voltage) becomes higher than the previous one, the modification circuit raises the present gray (or gray voltage) and outputs the same as shown in Equation 18, and when the present gray signal (or gray voltage) becomes lower than the previous one, the modification circuit lowers the present gray (or gray voltage) and outputs the same as shown in Equation 19. At this time, states of the modification are proportional to the difference between the present gray (or gray voltage) and the previous one as shown in the equation 20.

By the above-described modification process, the response speed of the LCD panel becomes faster based on the following reasons.

First, desired voltage is supplied. if 5V is supplied to liquid crystal cells, the actual 5V is supplied to the cells. When the liquid crystal reacts to the electric field and the direction of the director of the liquid crystal is changed, the capacitance also changes. Accordingly, the voltage different from the previous one is supplied to the liquid crystal.

Even when the response speed of the liquid crystal falls within one frame (16.7 ms, @60 Hz), the conventional AMLCD driving method does not provide accurate voltages because of the above-noted mechanism, but the voltage between the previous and present voltages. Accordingly, the actual response speed of the LCD panel is delayed more than one frame.

By modifying signals, desired voltages are supplied and rendering correct response. Overcompensations correct the transmission errors the liquid crystal respond to the electric field.

Second, the response time of the liquid crystal material generally becomes faster as the voltage varies a lot. For example, when rising, the response speed is faster when the voltage switches from 1V to 3V than when switching from 1V to 2V. When falling, the response speed is faster when the voltage switches from 3V to 1V than when switching from 3V to 2V.

This tendency is preserved in most cases even though there are some differences depending on the liquid crystal or the driving modes of the LCD. In the twisted nematic mode, the response speed becomes 15 times faster when rising and the response speed becomes 1.5 times faster when falling, as the voltage difference widens.

Third, when the response time of the liquid crystal exceeds the period of one frame (16.7 ms), the response time can be shortened within one frame period by a forced traction method. Let's assume that a response time of a liquid crystal is 30 ms when the voltage change a from 1V to 2V. In other words, in order to obtain the transmission corresponding to 2V, it takes 30 ms when 2V voltage is supplied.

When it is assumed that a time for the identical liquid crystal to reach 3V from 1V is also 30 ms (in most cases, the time is shorter), the liquid crystal reaches its target transmission corresponding to 2V before 30 ms. That is, when supplying 3V in order to obtain desired transmission corresponding to 2V, the liquid crystal reaches its target transmission corresponding to 2V in a time period shorter than 30 ms.

When continuously supplying 3V, the liquid crystal reaches 3V. Accordingly, the accessive voltage is cut off when the voltage reaches 2V, and then 2V is supplied. Then, the liquid crystal reaches 2V in a time period shorter than 30 ms. A time to cut off the voltage, that is, to switch the voltage is when the frame is switched. Therefore, if the voltage of the liquid crystal reaches 2V after a single frame (16.7 ms), 3V voltage is supplied for one frame and switched to 2V at a subsequent frame, effectively achieving the response time of 16.7 ms. In this case, the transmission errors during the response time (e.g., 16.7 ms) of the liquid crystal can be set off using the compensation method.

According to the above-noted embodiment of the present invention, the pixel voltage can reach the target voltage level by modifying the data voltage and supplying the modified data voltage to the pixels. Hence, the response speed of the liquid crystal can be improved without modifying the configuration of the TFT LCD panel.

Also, in the case of driving the LCD and particularly in the case of implementing the moving pictures, the size of the gray lookup table of the image signal modification circuit that enhances the response speed of the liquid crystal can be reduced and the quantization errors can be removed.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A liquid crystal display (LCD), comprising:

a data gray signal modifier for receiving gray signals from a data gray signal source, and outputting modification gray signals by considering gray signals of present and previous frames;

a data driver for changing the modification gray signals into corresponding data voltages and outputting image signals;

a gate driver for sequentially supplying scanning signals; and an LCD panel comprising a plurality of gate lines for transmitting the scanning signals; a plurality of data lines, insulated from and crossing the gate lines, for transmitting the image signals; and a plurality of pixels, formed by an area surrounded by the gate lines and the data lines and arranged as a matrix pattern, having switching elements connected to the gate lines and data lines, wherein the data gray signal modifier comprises:

a frame storage device for receiving the gray signals from the data gray signal source, storing the gray signals for a period of one frame, and outputting the same;

a controller for controlling writing and reading the gray signals of the frame storage device; and a data gray signal converter for considering the gray signals of a present frame transmitted by the data gray signal source and the gray signals of a previous frame transmitted by the frame storage device, and outputting the modification gray signals, wherein the data gray signal converter modifies the gray signals so as to output a modification data voltage $V_n'$ that satisfies the following equation $$|V_n'|=|V_n|+f(|V_n|-|V_{n-1}|)$$

where the data voltage of the present frame is set to be $V_n$ and that of the previous frame to be $V_{n-1}$.

2. The LCD of claim 1, wherein the data gray signal converter uses a digital circuit to output modified gray signals that satisfy the above-noted equation.

3. A liquid crystal display (LCD), comprising:

a data gray signal modifier for receiving gray signals from a data gray signal source, and outputting modification gray signals by considering gray signals of present and previous frames;

a data driver for changing the modification gray signals into corresponding data voltages and outputting image signals;

a gate driver for sequentially supplying scanning signals; and an LCD panel comprising a plurality of gate lines for transmitting the scanning signals; a plurality of data lines, insulated from and crossing the gate lines, for transmitting the image signals; and a plurality of pixels, formed by an area surrounded by the gate lines and the data lines and arranged as a matrix pattern, having switching elements connected to the gate lines and data lines, wherein the data gray signal modifier comprises:

a frame storage device for receiving the gray signals from the data gray signal source, storing the gray signals for a period of one frame, and outputting the same;

a controller for controlling writing and reading the gray signals of the frame storage device; and a data gray signal converter for considering the gray signals of a present frame transmitted by the data gray signal source and the gray signals of a previous frame transmitted by the frame storage device, and outputting the modification gray signals, wherein the data gray signal converter comprises a storage device for storing a lookup table for writing modification gray signals corresponding to the gray signals of the present and previous frames, and wherein when the modification gray signal is greater than a first voltage, the lookup table sets the modification gray signal as the first voltage, and when the modification gray signal is less than a second voltage, the lookup table sets the modification gray signal as the second voltage.

4. A liquid crystal display (LCD), comprising:

a data gray signal modifier for receiving gray signals from a data gray signal source, and outputting modification gray signals by considering gray signals of present and previous frames;

a data driver for changing the modification gray signals into corresponding data voltages and outputting image signals;

a gate driver for sequentially supplying scanning signals; and an LCD panel comprising a plurality of gate lines for transmitting the scanning signals; a plurality of data lines, insulated from and crossing the gate lines, for transmitting the image signals; and a plurality of pixels, formed by an area surrounded by the gate lines and the data lines and arranged as a matrix pattern, having switching elements connected to the gate lines and data lines, wherein the data gray signal modifier receives n-bit gray signals with respect to red R, green G and blue B signals from the data gray signal source, and outputs modification gray signals by considering the m-bit gray signals of the present and previous frames among n-bit gray signals.

5. The LCD of claim 4, wherein the data gray signal modifier comprises:

a frame storage device for receiving the m-bit gray signals from the data gray signal source, storing the gray signals during a single frame, and outputting the same;

a controller for controlling writing and reading the gray signals of the frame storage device; and a data gray signal converter for considering the m-bit gray signals of a present frame transmitted by the data gray signal source and the gray signals of a previous frame transmitted by the frame storage device, and generating and outputting the modification gray signals.

6. The LCD of claim 5, wherein the number 'm' represents remaining bits obtained by subtracting bits from the least significant bit (LSB) to 'i' (i=0, 1, . . . , n−1) among the 'n' bits of the gray signals.

7. The LCD of claim 5, wherein the number 'm' changes according to R, G and B.

8. The LCD of claim 7, wherein the number 'm' is the biggest with respect to B.

9. The LCD of claim 7, wherein the number 'm' is the smallest with respect to G.

10. The LCD of claim 5, wherein the data gray signal converter receives unmodified (n−m) bits among the n-bit gray signals received from the data gray signal source, adds the received (n−m) bits to the gray signals generated by considering the gray signals of the present and previous frames, and generates n-bit modification gray signals.

11. The LCD of claim 5, wherein the frame storage device comprises:

a first frame storage device that writes outputs of the m-bit odd-numbered gray signals of the data gray signal source and reads outputs of the m-bit even-numbered gray signals; and a second frame storage device that reads the outputs of the m-bit odd-numbered gray signals of the data gray signal source and writes the outputs of the m-bit even-numbered gray signals.

12. The LCD of claim 5, wherein the data gray signal converter modifies the gray signals so as to output a modification data voltage $V_n'$ that satisfies the following equation $$|V_n'|=|V_n|+f(|V_n|-|V_{n-1}|)$$

where the data voltage of the present frame is set to be $V_n$ and that of the previous frame to be $V_{n-1}$.

13. The LCD of claim 12, wherein the data gray signal converter uses a digital circuit to output modified gray signals that satisfy the above-noted equation.

14. The LCD of claim 5, wherein the data gray signal converter comprises a storage device for storing a lookup table for writing modification gray signals corresponding to the gray signals of the present and previous frames.

15. The LCD of claim 14, wherein when the modification gray signal is greater than a first voltage, the lookup table sets the modification gray signal as the first voltage, and when the modification gray signal is less than a second voltage, the lookup table sets the same as the second voltage.

16. A liquid crystal display (LCD), comprising:

a data tray signal modifier for receiving gray signals from a data gray signal source, and outputting modification gay signals by considering gray signals of present and previous frames;

a data driver for changing the modification gray signals into corresponding data voltages and outputting image signals;

a gate driver for sequentially supplying scanning signals; and an LCD panel comprising a plurality of gate lines for transmitting the scanning signals; a plurality of data lines, insulated from and crossing the gate lines, for transmitting the image signals; and a plurality of pixels, formed by an area surrounded by the gate lines and the data lines and arranged as a matrix pattern, having switching elements connected to the gate lines and data lines, wherein the data gray signal modifier receives x-bit gray data with respect to R, G and B from the data gray signal source and performs a first modification on a predetermined MSB bits of the respective x-bit gray data of the present and previous frames by using the lookup table, performs a second modification on respective remaining bits of the gray data of the present and previous frames via a predetermined computation, and outputs modification gray data via the first and second modifications.

17. The LCD of claim 16, wherein the data gray signal modifier comprises:

a frame storage device for receiving the x-bit gray data from the data gray signal source, storing the gray data for a period of one frame, and outputting the same;

a controller for controlling writing and reading the gray data of the frame storage device; and a data gray signal converter for considering the x-bit gray data of a present frame transmitted by the data gray signal source and the gray data of a previous frame transmitted by the frame storage device, generating modification gray data and outputting the same to the data driver.

18. The LCD of claim 17, wherein the data gray signal converter comprises:

a lookup table for respectively receiving MSB y-bit data of the x-bit data of the previous and present image data, and outputting variables (f, a, b) for a modification of moving pictures; and a calculator for respectively receiving LSB z-bit data of the x-bit data of the previous and present image data, receiving the variables (f, a, b) and outputting the modified gray data.

19. The LCD of claim 18, wherein the modified gray data $G_n'$ are obtained using an equation:

$$G_n' = f([G_n]_z, [G_{n-1}]_z) + a([G_n]_z, [G_{n-1}]_z)\cdot\frac{{}_y[G_n]}{2^z} - b([G_n]_z, [G_{n-1}]_z)\cdot\frac{{}_y[G_n]}{2^z}$$

where z=x−y, $[G_n]_z$ represents that zeros are provided to all the LSB z bits of Gn, $[G_{n-1}]_z$ represents that zeros are provided to all the LSB z bits of $G_{n-1}$, ${}_y[G_n]$ represents that zeros are provided to all the MSB y bits of $G_n$, and a and b are positive integers.

20. The LCD of claim 19, wherein if a−b=16 in the case of $[G_n]_z=[G_{n-1}]_z$, the condition of $G_n'=G_{n-1}$ is satisfied.

21. The LCD of claim 18, wherein the modified gray data $G_n'$ are obtained using an equation:

$$G_n' = f' + [G_n]_z + a\cdot([G_n]_z, [G_{n-1}]_z)\cdot\frac{{}_y[G_n]}{2^z} - b\cdot([G_n]_z, [G_{n-1}]_z)\cdot\frac{{}_y[G_n]}{2^z}$$

where z=x−y, $f'=f([G_n]_z,[G_{n-1}]_z)-[G_n]_z$, and $[G_n]_z$ represents that zeros are provided to all the LSB z bits of $G_n$, and $[G_{n-1}]_z$ represents that zeros are provided to all the LSB z bits of $G_{n-1}$, and ${}_y[G_n]$ represents that zeros are provided to all the MSB y bits of $G_n$, and a and b are positive integers.

22. The LCD of claim 18, wherein the modified gray data $G_n'$ are obtained using an equation:

$$G_n' = f'([G_n]_z, [G_{n-1}]_z) + G_n + a'\cdot([G_n]_z, [G_{n-1}]_z)\cdot\frac{{}_y[G_n]}{2^z} - b\cdot$$

-continued $$([G_n]_z, [G_{n-1}]_z) \cdot \frac{{}_y[G_n]}{2^z}$$

where z=x−y, f'=f−$G_n$, and $[G_n]_z$ represents that zeros are provided to all the LSB z bits of $G_n$, and $[G_{n-}]_z$ represents that zeros are provided to all the LSB z bits of $G_{n-1}$ and ${}_y[G_n]$ represents that zeros are provided to all the MSB y bits of $G_n$, and the value a' is an integer, and the value b is a positive integer.

23. The LCD of claim 22, wherein if a−b=0 in the case of $[G_n]_z=[G_{n-1}]_z$, the condition of $G_n'=G_{n-1}$ is satisfied.

24. A liquid crystal display (LCD), comprising:

an LCD panel comprising a plurality of gate lines for transmitting scanning signals; a plurality of data lines, insulated from and crossing the gate lines, for transmitting data voltages; and a plurality of pixels, formed by an area surrounded by the gate lines and data lines and arranged as a matrix pattern, having switching elements connected to the gate lines and data a gate driver for sequentially supplying the scanning signals to the gate lines;

a gate driver for sequentially supplying the scanning signals to the gate lines;

a data gray signal modifier for receiving a data voltage from a data voltage source, and outputting a modification data voltage by considering data voltages of present and previous frames; and a data driver for supplying the modification data voltages output by the data gray signal modifier to the data lines, wherein the data gray signal modifier modifies the gray signals so as to output a modification data voltage $V_n'$ that satisfies the following equation $$|V_n'|=|V_n|+f(|V_n|-|V_{n-1}|)$$

where the data voltage of the present frame is set to be $V_n$ and that of the previous frame to be $V_{n-1}$.

25. In a liquid crystal display (LCD) comprising a plurality of gate lines; a plurality of data lines being insulated from and crossing the gate lines; and a plurality of pixels, formed by an area surrounded by the gate lines and data lines and arranged as a matrix pattern, having switching elements connected to the gate lines and data lines, an LCD driving method, comprising step of:

(a) sequentially supplying scanning signals to the gate lines;

(b) receiving image signals from an image signal source, and generating modification image signals by considering image signals of present and previous frames; and (c) supplying data voltages corresponding to the generated modification image signals to the data lines, wherein the modification image signals satisfy the following equation $$|V_n'|=|V_n+f(|V_n|-|V_{n-1}|)$$

where the data voltage of the present frame is set to be $V_n$ and that of the previous frame to be $V_{n-1}$.

26. In a liquid crystal display (LCD) comprising a plurality of gate lines; a plurality of data lines being insulated from and crossing the gate lines; and a plurality of pixels, formed by an area surrounded by the gate lines and data lines and arranged as a matrix pattern, having switching elements connected to the gate lines and data lines, an LCD driving method, comprising step of:

(a) sequentially supplying scanning signals to the gate lines;

(b) receiving image signals from an image signal source, and generating modification image signals by considering image signals of present and previous frames; and (c) supplying data voltages corresponding to the generated modification image signals to the data lines, wherein the image signals are identified as digital gray signals, wherein step (b) comprises:

delaying the image signals transmitted from the image signal source by as long as a period of a single frame; and generating modification image signals by considering the image signals of the present frame received from the image signal source and the delayed image signals of the previous frame, wherein in step (b), a lookup table for writing modification image signals corresponding to the image signals of the previous and present frames is searched and the modification image signals are generated, and wherein when the modification image signals are greater than a first voltage, the lookup table sets the modification image signals as the first voltage, and when the modification image signals are less than a second voltage, the lookup table sets the modification image signals as the second voltage.

27. In a liquid crystal display (LCD) comprising a plurality of gate lines; a plurality of data lines insulated from and crossing the gate lines; and a plurality of pixels, formed by an area surrounded by the gate lines and data lines and arranged as a matrix pattern, having switching elements connected to the gate lines and data lines, an LCD driving method, comprising steps of:

(a) sequentially supplying scanning signals to the gate lines;

(b) receiving x-bit image gray data from an outer image signal source;

(c) delaying the image gray data by a single frame;

(d) extracting variables to modify the moving pictures from the lookup table by using MSB y bits of a single-frame delayed digital gray data and MSB y bits of the digital gray data received at the present frame;

(e) computing LSB (x−y) bits of the single-frame delayed digital gray data, LSB (x−y) bits of the digital gray data received at the present frame, and the variables extracted from the (d); and (f) supplying the data voltage corresponding to the modified gray data to the data line.

28. The LCD driving method of claim 27, wherein the modified gray data $G_n'$ is obtained according to an equation:

$$G_n' = f([G_n]_z, [G_{n-1}]_z) + a([G_n]_z, [G_{n-1}]_z) \cdot \frac{{}_y[G_n]}{2^z} - b([G_n]_z, [G_{n-1}]_z) \cdot \frac{{}_y[G_n]}{2^z}$$

where z=x−y, $[G_n]_z$ represents that zeros are provided to all the LSB z bits of Gn, $[G_{n-1}]_z$ represents that zeros are provided to all the LSB z bits of $G_{n-1}$, ${}_y[G_n]$ represents that zeros are provided to all the MSB y bits of $G_n$, and a and b are positive integers.

29. The LCD driving method of claim 28, wherein if a−b=16 in the case of $[G_n]_z=[G_{n-1}]_z$, the condition of $G_n'=G_{n-1}$ is satisfied.

30. The LCD driving method of claim 27, wherein the modified gray data $G_n'$ are obtained using an equation:

$$G_n' = f' + [G_n]_z + a \cdot ([G_n]_z, [G_{n-1}]_z) \cdot \frac{{}_y[G_n]}{2^z} - b \cdot ([G_n]_z, [G_{n-1}]_z) \cdot \frac{{}_y[G_n]}{2^z}$$

where z=x−y, f'=f([$G_n$]$_z$,[$G_{n-1}$]$_z$)−[$G_n$]$_z$, and [$G_n$]$_z$ represents that zeros are provided to all the LSB z bits of $G_n$, and [$G_{n-1}$]$_z$ represents that zeros are provided to all the LSB z bits of $G_{n-1}$, and $_y$[$G_n$] represents that zeros are provided to all the MSB y bits of $G_n$, and a and b are positive integers.

31. The LCD driving method of claim 27, wherein the modified gray data $G_n'$ are obtained using an equation:

$$G_n' = f'([G_n]_z, [G_{n-1}]_z + G_n + a' \cdot ([G_n]_z, [G_{n-1}]_z) \cdot \frac{{}_y[G_n]}{2^z} - b \cdot ([G_n]_z, [G_{n-1}]_z) \cdot \frac{{}_y[G_n]}{2^z}$$

where z=x−y, f'=f−$G_n$, and [$G_n$]$_z$ represents that zeros are provided to all the LSB z bits of $G_n$, and [$G_{n-1}$]$_z$ represents that zeros are provided to all the LSB z bits of $G_{n-1}$, and $_y$[$G_n$] represents that zeros are provided to all the MSB y bits of $G_n$, and the value a' is an integer, and the value b is a positive integer.

32. The LCD driving method of claim 31, wherein if a−b=0 in the case of [$G_n$]$_z$=[$G_{n-1}$]$_z$, the condition of $G_n'$=$G_{n-1}$ is satisfied.

33. In a liquid crystal display (LCD) comprising a plurality of gate lines; a plurality of data lines insulated from and crossing the gate lines; and a plurality of pixels, formed by an area surrounded by the gate lines and data lines and arranged as a matrix pattern, having switching elements connected to the gate lines and data lines, an LCD driving apparatus, comprising:

a data gray signal modifier for receiving x-bit gray signals from a data gray signal source, performing a first modification on predetermined MSBs of respective x-bit gray data of the present and previous frames by using a lookup table, performing a second modification on respective remaining bits of gray data of the present and previous frames via a predetermined computation, and outputting modification gray signals via the first and second modifications;

a data driver for changing the modification gray signals output from the data gray signal modifier into data voltages corresponding to the modification gray data and outputting image signals to the data lines; and a gate driver for sequentially supplying scanning signals to the gate lines.

34. The LCD driving apparatus of claim 33, wherein the data gray signal modifier comprises:

a frame storage device for receiving the x-bit gray data from the data gray signal source, storing the gray data for a period of a single frame, and outputting the same;

a controller for controlling writing and reading the gray data of the frame storage device; and a data gray signal converter for considering the x-bit gray data of a present frame transmitted by the data gray signal source and the x-bit gray data of a previous frame transmitted by the frame storage device, generating the modification gray data and outputting the modification gray data to the data driver.

35. The LCD driving apparatus of claim 34, wherein the data gray signal converter comprises:

a lookup table for respectively receiving MSB y-bit data of the x-bit image data of the previous and present frames, and outputting variables (f, a, b) for a modification of moving pictures; and a calculator for respectively receiving LSB z-bit data of the x-bit data of the previous and present image data, receiving the variables (f, a, b) and outputting the modified gray data.

36. The LCD driving apparatus of claim 35, wherein the modified gray data $G_n'$ are obtained using the subsequent equation:

$$G_n' = f([G_n]_z, [G_{n-1}]_z) + a([G_n]_z, [G_{n-1}]_z) \cdot \frac{{}_y[G_n]}{2^z} - b([G_n]_z, [G_{n-1}]_z) \cdot \frac{{}_y[G_n]}{2^z}$$

where z=x−y, [$G_n$]$_z$ represents that zeros are provided to all the LSB z bits of Gn, [$G_{n-1}$]$_z$ represents that zeros are provided to all the LSB z bits of $G_{n-1}$, $_y$[$G_n$] represents that zeros are provided to all the MSB y bits of $G_n$, and a and b are positive integers.

37. The LCD of claim 36, wherein if a−b=16 in the case [$G_n$]$_z$=[$G_{n-1}$]$_z$, the condition that $G_n'$=$G_{n-1}$ is satisfied.

38. The LCD driving apparatus of claim 35, wherein the modified gray data $G_n'$ are obtained using the subsequent equation:

$$G_n' = f' + [G_n]_z + a \cdot ([G_n]_z, [G_{n-1}]_z) \cdot \frac{{}_y[G_n]}{2^z} - b \cdot ([G_n]_z, [G_{n-1}]_z) \cdot \frac{{}_y[G_n]}{2^z}$$

where it is defined that z=x−y, f'=f([$G_n$]$_z$,[$G_{n-1}$]$_z$)−[$G_n$]$_z$, and [$G_n$]$_z$ represents that zeros are provided to all the LSB z bits of $G_n$, and [$G_{n-1}$]$_z$ represents that zeros are provided to all the LSB z bits of $G_{n-1}$, and $_y$[$G_n$] represents that zeros are provided to all the MSB y bits of $G_n$, and the values a and b are positive integers.

39. The LCD driving apparatus of claim 35, wherein the modified gray data $G_n'$ are obtained using the subsequent equation:

$$G_n' = f'([G_n]_z, [G_{n-1}]_z) + G_n + a' \cdot ([G_n]_z, [G_{n-1}]_z) \cdot \frac{{}_y[G_n]}{2^z} - b \cdot ([G_n]_z, [G_{n-1}]_z) \cdot \frac{{}_y[G_n]}{2^z}$$

where it is defined that z=x−y, f'=f−$G_n$, and [$G_n$]$_z$ represents that zeros are provided to all the LSB z bits of $G_n$, and [$G_{n-1}$]$_z$ represents that zeros are provided to all the LSB z bits of $G_{n-1}$, and $_y$[$G_n$] represents that zeros are provided to all the MSB y bits of $G_n$, and the value a' is an integer, and the value b is a positive integer.

40. The LCD of claim 39, wherein if a−b=0 in the case [$G_n$]$_z$=[$G_{n-1}$]$_z$, the condition that $G_n'$=$G_{n-1}$ is satisfied.

* * * * *